US010221033B2

(12) United States Patent
Obara et al.

(10) Patent No.: US 10,221,033 B2
(45) Date of Patent: Mar. 5, 2019

(54) SHEET DISCHARGE APPARATUS AND IMAGE FORMING APPARATUS INCLUDING THE SAME

(71) Applicant: CANON KABUSHIKI KAISHA, Tokyo (JP)

(72) Inventors: Yuichi Obara, Yamato (JP); Masaaki Takeuchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/642,202

(22) Filed: Jul. 5, 2017

(65) Prior Publication Data

US 2018/0022564 A1 Jan. 25, 2018

(30) Foreign Application Priority Data

Jul. 19, 2016 (JP) ..... 2016-141003

(51) Int. Cl.
*B65H 31/20* (2006.01)
*B65H 31/22* (2006.01)

(52) U.S. Cl.
CPC ..... *B65H 31/20* (2013.01); *B65H 31/22* (2013.01); *B65H 2402/32* (2013.01); *B65H 2405/1122* (2013.01); *B65H 2405/1124* (2013.01); *B65H 2405/111646* (2013.01); *B65H 2405/324* (2013.01); *B65H 2601/321* (2013.01); *B65H 2601/324* (2013.01); *B65H 2801/06* (2013.01)

(58) Field of Classification Search
CPC ..... B65H 31/20; B65H 2405/324; B65H 2405/1122; B65H 2405/1124; B65H 31/22; B65H 2405/111646
See application file for complete search history.

(56) References Cited

U.S. PATENT DOCUMENTS 5,897,113 A * 4/1999 Kondo ..... G03G 15/60 271/207
9,242,827 B2 * 1/2016 Niimura ..... B65H 31/22
2014/0103603 A1 * 4/2014 Horita ..... B65H 31/02 271/171

(Continued)

FOREIGN PATENT DOCUMENTS

JP 2003112847 A 4/2003
JP 2005247486 A 9/2005

(Continued)

*Primary Examiner* — Patrick Cicchino

(74) *Attorney, Agent, or Firm* — Canon U.S.A., Inc. IP Division

(57) ABSTRACT

A sheet discharge apparatus includes a main tray, a discharge unit, and an expansion tray. The main tray is pivotable between a closed position and open position relative to a sheet discharge apparatus main body. The discharge unit discharges the sheet onto the main tray in the closed position. The expansion tray expands a main tray stacking area and is movable between a storage position where the expansion tray is stored in the main tray and an expansion position where the expansion tray is slid from the storage position in a sheet discharge direction and expands the stacking area. At the expansion position, the expansion tray is pivotable independently of the main tray. A direction in which the expansion tray is pivoted upward is the same as a direction in which the main tray is pivoted from the closed to the opened position.

15 Claims, 22 Drawing Sheets

(56) References Cited

U.S. PATENT DOCUMENTS

| | | | | |
|---|---|---|---|---|
| 2014/0167349 | A1* | 6/2014 | Niimura | B65H 31/22<br>271/213 |
| 2014/0319760 | A1* | 10/2014 | Komuro | B65H 31/20<br>271/223 |
| 2017/0121145 | A1* | 5/2017 | Otsuka | B65H 31/20 |

FOREIGN PATENT DOCUMENTS

| | | | | | |
|---|---|---|---|---|---|
| JP | 2006188363 | A | | 7/2006 | |
| JP | 2007176693 | A | | 7/2007 | |
| JP | 2007328302 | A | | 12/2007 | |
| JP | 2010132434 | A | * | 6/2010 | B65H 31/02 |

* cited by examiner

SHEET DISCHARGE APPARATUS AND IMAGE FORMING APPARATUS INCLUDING THE SAME

BACKGROUND OF THE INVENTION

Field of the Invention

The disclosed information relates to sheet discharge devices for use in image forming apparatuses such as electrophotographic copying machines and electrophotographic printers.

Description of the Related Art

Conventional image forming apparatuses such as electrophotographic copying machines and electrophotographic printers in which a tray for stacking sheets with images printed thereon by an image forming unit is provided above the image forming unit are known.

FIGS. 21A and 21B illustrate an example of a conventional image forming apparatus (the illustrated example is a monochrome laser printer) 200.

As illustrated in FIG. 21A, an image forming unit 10 includes a cartridge 20 and a transfer member 5. The cartridge 20 includes a photosensitive drum 1, a charging member 2, and a development device 3, which are integrated. The cartridge 20 can be attached to and detached from an apparatus body 200A in a direction of an arrow A specified in FIG. 21B. Further, an exposure device 4 is provided.

A tray 91 provided above the image forming unit 10 can be opened and closed with a pivot shaft 91*a* (refer to FIG. 21A) of the tray 91 being a fulcrum with respect to the apparatus body 200A. The tray 91 is caused to pivot as illustrated in FIG. 21B to open an opening portion 21 of the apparatus body 200A. Then, the cartridge 20 can be attached to or detached from a cartridge attachment portion 22 of the apparatus body 200A.

Sheets S stored in a cassette 6 are fed one by one by a roller 7, and a roller 8 conveys the fed sheet S to a transfer nip portion formed by the photosensitive drum 1 and the transfer member 5. The sheet S is conveyed while being sandwiched by the transfer nip portion, and during the conveying process, a toner image is transferred from the photosensitive drum 1 onto the sheet S by the transfer member 5. The sheet S with the unfixed toner image is passed through a fixing device 30 to heat and fix the toner image onto the sheet S. The sheet S ejected from the fixing device 30 is discharged onto the tray 91 by a roller (discharge unit) 40.

In order to allow stacking of longer sheets than a standard sheet length, the above-described image forming apparatus 200 includes an expansion tray 92 (refer to FIG. 21A) for extending a sheet stacking area of the tray 91. The expansion tray 92 is provided to the tray 91 in such a manner that the expansion tray 92 can be opened and closed with respect to the tray 91. Including the expansion tray 92 allows for the expansion tray 92 to be retracted into the tray 91 to reduce the occupied volume in the case of the standard sheet length or case in which the apparatus is not in use.

Meanwhile, there are known methods for opening/closing an expansion tray. In one method, an expansion tray is opened by rotating the expansion tray with respect to a tray (Japanese Patent Application Laid-Open No. 2007-328302). In another method, an expansion tray is pulled from a tray (Japanese Patent Application Laid-Open No. 2005-247486).

If the image forming apparatus 200 illustrated in FIGS. 21A and 21B employs the method of opening/closing an expansion tray by pulling the expansion tray, a user picking up a sheet from the tray 91 can hold and move the expansion tray 92 upward together with the sheet. Further, when setting new sheets into the cassette 6, the user can push the expansion tray 92 upward. When the user moves or pushes the expansion tray 92 upward, an issue can arise that the tray 91 connected to the expansion tray 92 is accidentally opened.

SUMMARY OF THE INVENTION

According to an aspect of the present invention, a sheet discharge apparatus comprising: a main tray on which a sheet is to be stacked and which is pivotable between a closed position at which the main tray is closed with respect to a main body of the sheet discharge apparatus and an opened position at which the main tray is opened with respect to the main body of the sheet discharge apparatus, a discharge unit configured to discharge the sheet onto the main tray in a case where the main tray is at the closed position, and an expansion tray configured to expand a stacking area of the main tray, wherein the expansion tray is provided to the main tray and movable between a storage position at which the expansion tray is stored in the main tray and an expansion position at which the expansion tray is slid from the storage position in a sheet discharge direction and expands the stacking area, wherein, at the expansion position, the expansion tray is pivotable on a pivot center provided to the main tray, in a vertically upward direction, by a predetermined angle, independently of the main tray, and wherein a direction in which the expansion tray is pivoted in the vertically upward direction is the same as a direction in which the main tray is pivoted from the closed position to the opened position.

Further features of the present invention will become apparent from the following description of embodiments with reference to the attached drawings.

DESCRIPTION OF THE EMBODIMENTS

Embodiments will be described below with reference to the drawings. The present invention is not limited to the following embodiments and the following embodiments can be appropriately modified or changed depending on individual constructions and various conditions of apparatuses to which the present invention is applied.

Figure 1A:
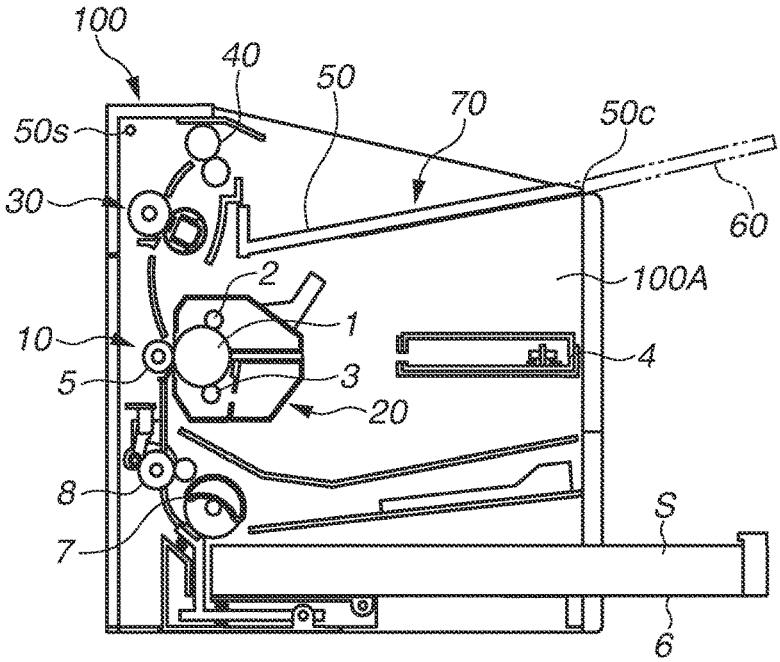
FIGS. 1A and 1B are cross sectional views schematically illustrating a configuration of an image forming apparatus.
Figure 1B:
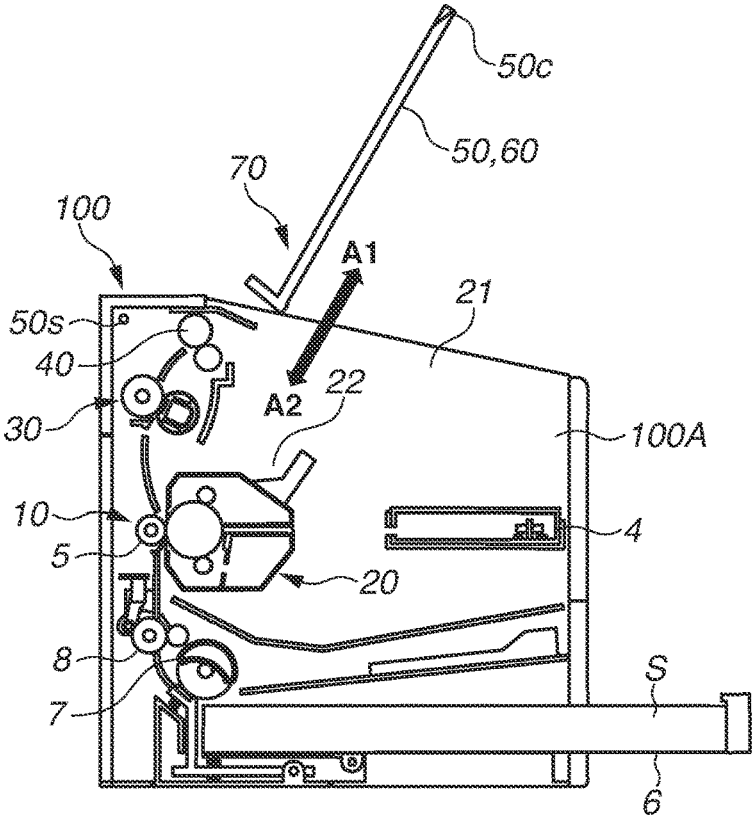

An image forming apparatus according to an embodiment will be described with reference to FIGS. 1A and 1B. FIG. 1A is a cross sectional view schematically illustrating an example of a configuration of an image forming apparatus 100 using an electrophotographic recording technique (in the present embodiment, the image forming apparatus 100 is a monochrome laser beam printer). FIG. 1B is a cross sectional view illustrating a state of the image forming apparatus 100 illustrated in FIG. 1A in which a tray 50 is pivoted to open an opening portion 21 in an apparatus body 100A.

In the image forming apparatus 100, an image forming unit 10 configured to form a toner image on a sheet S such as a recording sheet includes a photosensitive drum (image bearing member) 1, a charging member 2, a development device 3, a laser scanner (exposure device) 4, and a transfer member 5. The photosensitive drum 1, the charging member 2, and the development device 3 are integrated as a cartridge 20, which is removably attached to the apparatus body 100A. Operation of the image forming unit 10 is well known, so detailed description thereof is omitted.

The sheets S stored in a cassette 6 are fed one by one by a roller 7, and a roller 8 conveys the fed sheet S to a transfer nip portion formed by the photosensitive drum 1 and the transfer member 5. The sheet S onto which a toner image is transferred at the transfer nip portion is conveyed to a fixing device (fixing portion) 30, and the toner image is heated and fixed onto the sheet S by the fixing device 30. The sheet S ejected from the fixing device 30 is discharged onto a sheet stacking device (stacking portion) 70 by a roller 40.

The sheet stacking device 70 provided in an upper portion of the apparatus body 100A includes the tray (main tray) 50 for stacking the sheets S and an expansion tray 60. The expansion tray 60 is provided to the tray 50 and is pulled from the tray 50 to expand a sheet staking area of the tray 50.

The tray 50 is provided in an upper portion of the apparatus body 100A with a pivot shaft 50*s* being a fulcrum in such a manner that the tray 50 can be pivoted between closed and opened positions with respect to the apparatus body 100A. To detach the cartridge 20 from the apparatus body 100A, a user pivots the tray 50 while moving upward an edge portion (hereinafter, "front edge portion") 50*c* of the tray 50 which is on the opposite side to the pivot shaft 50*s* to open the opening portion 21 of the apparatus body 100A (refer to FIG. 1B). Then, the user holds the cartridge 20 and pulls the cartridge 20 from the cartridge attachment portion 22 in the direction of an arrow A1 to detach the cartridge 20 from the opening portion 21.

To attach the cartridge 20 to the cartridge attachment portion 22, the user holds the cartridge 20 and pushes the cartridge 20 in the direction of an arrow A2 from the opening portion 21 to set the cartridge 20 into a predetermined position in the cartridge attachment portion 22. After the setting of the cartridge 20 is completed, the user pivots the tray 50 while pushing the front edge portion 50*c* of the tray 50 downward to close the opening portion 21 (refer to FIG. 1A).

The position of the tray 50 illustrated in FIG. 1A is the closed position with respect to the apparatus body 100A, and the position of the tray 50 illustrated in FIG. 1B is the opened position with respect to the apparatus body 100A.

The following describes the sheet stacking device 70 according to the present embodiment with reference to FIGS. 2A to 2D and 3A to 3C.

Figure 2A:
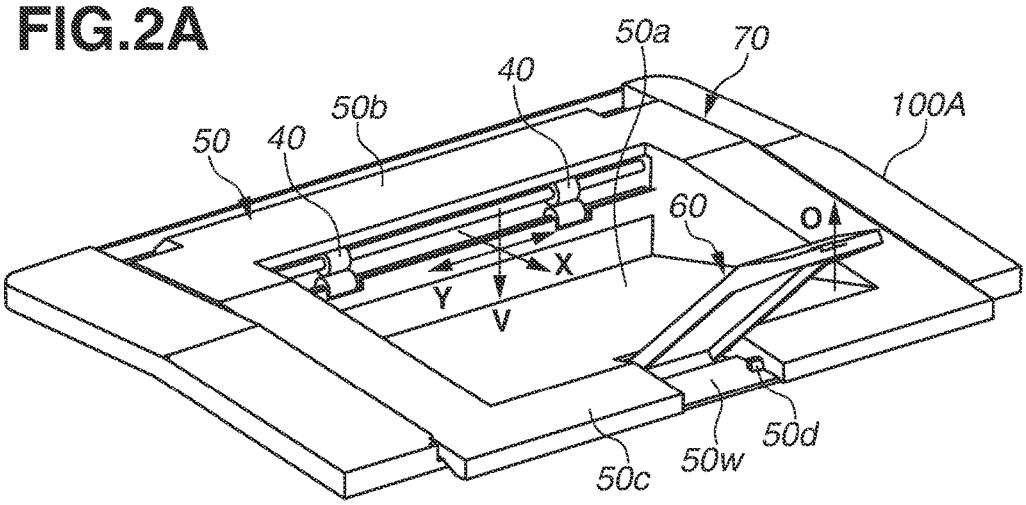
FIGS. 2A, 2B, 2C, and 2D are perspective views illustrating a configuration of a sheet stacking device according to a first embodiment.
Figure 2B:
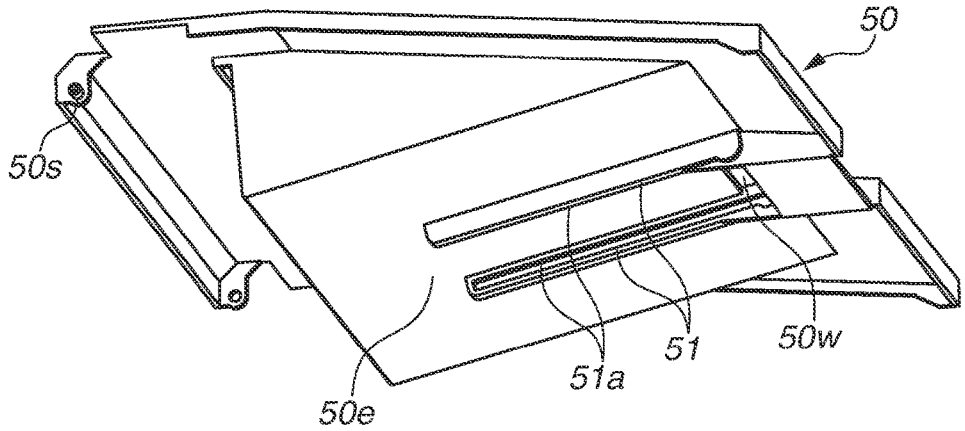
Figure 2C:
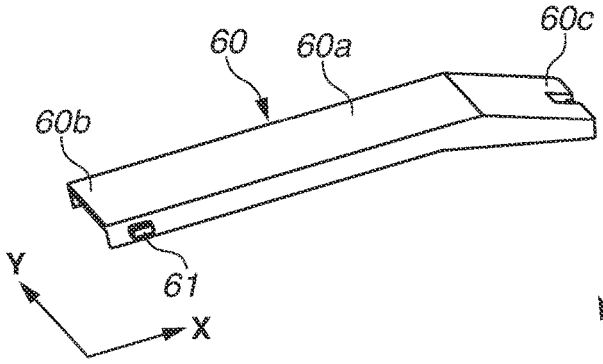
Figure 2D:
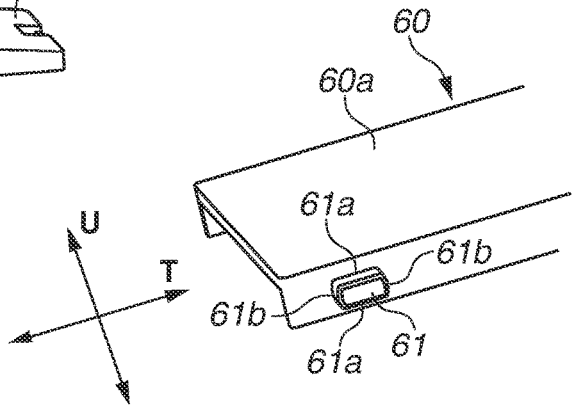

FIG. 2A is a perspective view illustrating the tray 50 provided in the upper portion of the apparatus body 100A and the expansion tray 60 pivoted in a direction O opposite to the vertical direction V with respect to the tray 50. FIG. 2B is a perspective view illustrating the tray 50 viewed from a back surface 50*e* side of the tray 50. FIG. 2C is a perspective view illustrating the expansion tray 60 viewed from a rear edge portion 60*b* side of the expansion tray 60. FIG. 2D is a perspective view illustrating a pivot shaft 61 of the expansion tray 60 illustrated in FIG. 2C.

As illustrated in FIG. 2A, the tray 50 includes a sheet stacking surface 50*a* on a front surface 50*b* side of the tray 50. As illustrated in FIGS. 2A and 2B, the tray 50 includes a pullout opening 50*w* on the front edge portion 50*c* side of the tray 50 in a discharge direction X in which the sheet S is discharged. The pullout opening 50*w* is formed in a central region of the sheet stacking surface 50*a* in a direction (width direction) Y which is orthogonal to the discharge direction X. The expansion tray 60 is attached through the pullout opening 50*w*. The expansion tray 60 is a member that is long in the discharge direction X.

The back surface 50*e*, which is on the opposite side to the sheet stacking surface 50*a*, of the tray 50 includes a pair of guide portions 51 in the width direction Y. The pair of guide portions 51 is provided to guide the expansion tray 60. The pair of guide portions 51 includes groove portions 51*a* for guiding the pair of pivot shafts (shaft) 61, which will be described below, of the expansion tray 60 from a retraction position to an extension position. The pair of groove portions 51*a* and the pair of pivot shafts 61 together form a rotation restriction unit Rr. The retraction position and the extension position will be described below.

In the present embodiment, the guide portions 51 are provided to the back side of the sheet stacking surface 50*a* of the tray 50 so that the sheet stacking surface 50*a* has a better appearance than that of a sheet stacking surface including guide portions provided on the front surface side of a tray.

As illustrated in FIG. 2C, the expansion tray 60 includes a sheet stacking surface 60*a* on a front surface of the expansion tray 60. Further, the expansion tray 60 includes the pair of pivot shafts 61 on the rear edge portion (one edge) 60*b* side of the expansion tray 60 in the discharge direction X. The pair of pivot shafts 61 is provided to support the expansion tray 60 in such a manner that the expansion tray 60 can be pivoted with respect to the tray 50. The pivot shafts 61 are respectively provided to lateral surfaces of the expansion tray 60 in the width direction Y.

As illustrated in FIG. 2D, each of the pair of pivot shafts 61 includes two arc portions 61*b* having a predetermined radius in a direction U which is orthogonal to a direction T parallel to a pull direction (refer to FIG. 3A) of the expansion tray 60 and which is orthogonal to the sheet stacking surface 60*a* of the expansion tray 60. More specifically, the arc portions 61*b* of the pivot shaft 61 are peripheral surfaces of the pivot shaft 61 on a front edge portion 60*c* side and the rear edge portion 60*b* side of the expansion tray 60.

Further, each of the pair of pivot shafts 61 includes two flat surface portions 61*a* connecting the two arc portions 61*b* in the direction T parallel to the pull direction of the expansion tray 60.

Figure 3A:
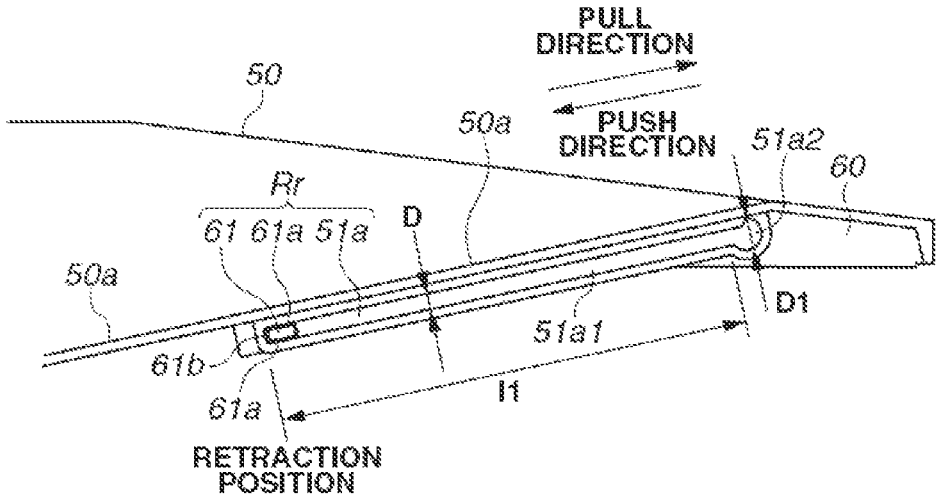
FIGS. 3A, 3B, and 3C illustrate movement of the sheet stacking device according to the first embodiment.
Figure 3B:
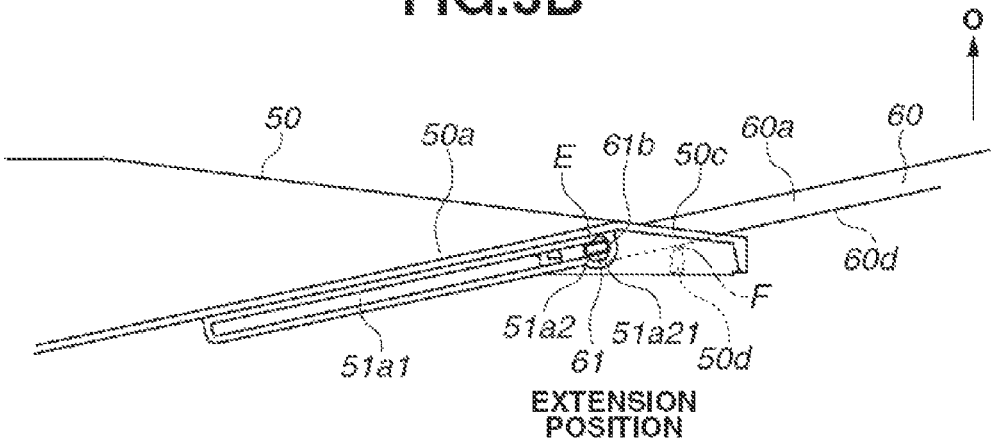
Figure 3C:
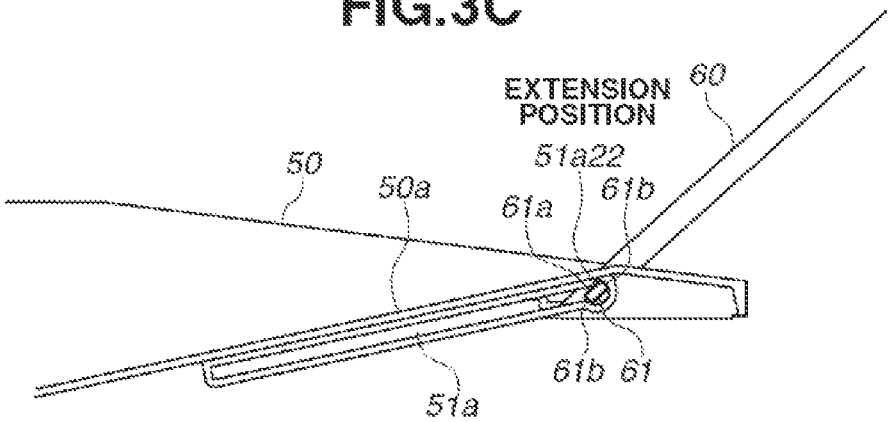

FIGS. 3A to 3C illustrate the connection structure of the tray 50 and the expansion tray 60 and movement of the expansion tray 60. The pair of guide portions 51 has the same structure, and the pair of pivot shafts 61 has the same structure, so only one of the guide portions 51 and one of the pivot shafts 61 will be described below.

FIG. 3A is a cross sectional view illustrating the tray 50 and the expansion tray 60 in the retraction position (storage position) in which the expansion tray 60 is retracted (stored) in the tray 50. FIG. 3B is a cross sectional view illustrating the tray 50 and the expansion tray 60 in the extension position (expansion position) in which the expansion tray 60 is slid from the retraction position in the discharge direction X to expand the sheet stacking area. FIG. 3C is a cross sectional view illustrating the tray 50 and the expansion tray 60 pivoted from the extension position in the direction (vertically upward direction) 0 opposite to the vertical direction V.

The expansion tray 60 is configured in such a manner that the position of the expansion tray 60 can be selected from (can be moved to) the retraction position illustrated in FIG. 3A and the extension position illustrated in FIG. 3B. The retraction position of the expansion tray 60 is the position in which the expansion tray 60 is pushed farthest in the tray 50. When the expansion tray 60 is in the retraction position, the sheets S are stacked only on the tray 50. The extension position of the expansion tray 60 is the position in which the expansion tray 60 is pulled (slid) farthest from the tray 50 in the discharge direction X. When the expansion tray 60 is in the extension position, the sheet S stacking area is expanded by the size of the expansion tray 60, and the sheets S are stacked on the tray 50 and the expansion tray 60.

The groove portion 51*a* is linearly formed. The groove portion 51*a* includes a first groove 51*a*1 and a second groove 51*a*2. The first groove 51*a*1 supports the pivot shaft 61 in such a manner that the pivot shaft 61 can be moved in a section I1 from the retraction position to a position before the extension position. The second groove 51*a*2 supports the pivot shaft 61 in such a manner that the pivot shaft 61 can be pivoted in the extension position.

In the retraction position, the flat surface portions 61*a* and the arc portions 61*b* of the pivot shaft 61 come into contact with the first groove 51*a*1 in the section I1 (refer to FIG. 3A). In a region of the section I1 that is on the right hand side of the retraction position, the flat surface portions 61*a* of the pivot shaft 61 are in contact with the first groove 51*a*1. The width D of the first groove 51*a*1 is set substantially equal to the distance (thickness) G between the flat surface portions 61*a* of the pivot shaft 61. Thus, the pivot shaft 61 fits in the first groove 51*a*1. Accordingly, in the section I1, the pivot shaft 61 is movably supported by the first groove 51*a*1 so that the expansion tray 60 can be moved along the first groove 51*a*1.

In the extension position, the arc portions 61*b* of the pivot shaft 61 are in contact with the second groove portion 51*a*2 formed in the shape of a substantially semicircular arc (refer to a first contact portion E in FIG. 3B). The width D1 (refer to FIG. 3A) of the second groove portion 51*a*2 is greater than the width D. Further, in the extension position, a back surface 60*d* of the expansion tray 60 is in contact with a projection portion 50*d* provided to the front edge portion 50*c* of the tray 50 in a central region of the tray 50 (refer to a second contact portion F in FIG. 3B). Thus, the expansion tray 60 is supported in stable orientation by the second groove portion 51*a*2 in the extension position to allow stable stacking of long sheets.

If the expansion tray 60 in the extension position is pivoted in the direction O opposite to the vertical direction V by a user, the arc portions 61*b* of the pivot shaft 61 are moved along an arc surface 51*a*21 of the second groove 51*a*2 (refer to FIG. 3B). If the expansion tray 60 is further pivoted in the direction O, the flat surface portions 61*a* of the pivot shaft 61 come into contact with an end surface 51*a*22 of the second groove 51*a*2 to stop the pivoting of the expansion tray 60 in the direction O. Thus, the expansion tray 60 becomes pivotable on the pivot shaft 61 in the direction O opposite to the vertical direction V within a predetermined range.

More specifically, in the section I1, the pivoting of the expansion tray 60 in the direction O opposite to the vertical direction V is restricted, and in the extension position, the expansion tray 60 is pivotable in the direction O opposite to the vertical direction V.

The pivoting of the expansion tray 60 in the vertical direction V in the extension position is restricted at two points that are the second contact portion F and the first contact portion E.

To retract the expansion tray 60 into the tray 50, the expansion tray 60 is pushed in an opposite direction to the discharge direction X with respect to the tray 50 when the expansion tray 60 is in the extension position.

In the sheet stacking device 70 according to the present embodiment, the expansion tray 60 can be pulled from and pushed into the tray 50. Further, the expansion tray 60 is supported in such a manner that the expansion tray 60 can be pivoted in the direction O opposite to the vertical direction V with respect to the tray 50. Thus, the expansion tray 60 can be moved and rotated with respect to the tray 50 with ease.

Further, in the sheet stacking device 70 according to the present embodiment, the direction in which the expansion tray 60 is pivoted in the direction O opposite to the vertical direction V is the same as the direction in which the tray 50 is pivoted from the closed position to the opened position. Thus, when a user picks up a discharged sheet S from the tray 50, even if the user accidentally holds and moves the expansion tray 60 upward together with the sheet S, only the expansion tray 60 is pivoted in the direction O opposite to the vertical direction V with respect to the tray 50 while the tray 50 is not pivoted. Similarly, when the user sets new sheets S into the cassette 6, even if the user accidentally pushes the expansion tray 60 upward, only the expansion tray 60 is pivoted with respect to the tray 50. As described above, even if the user accidentally moves or pushes the expansion tray 60 upward, the tray 50 remains at rest.

Figure 4A:
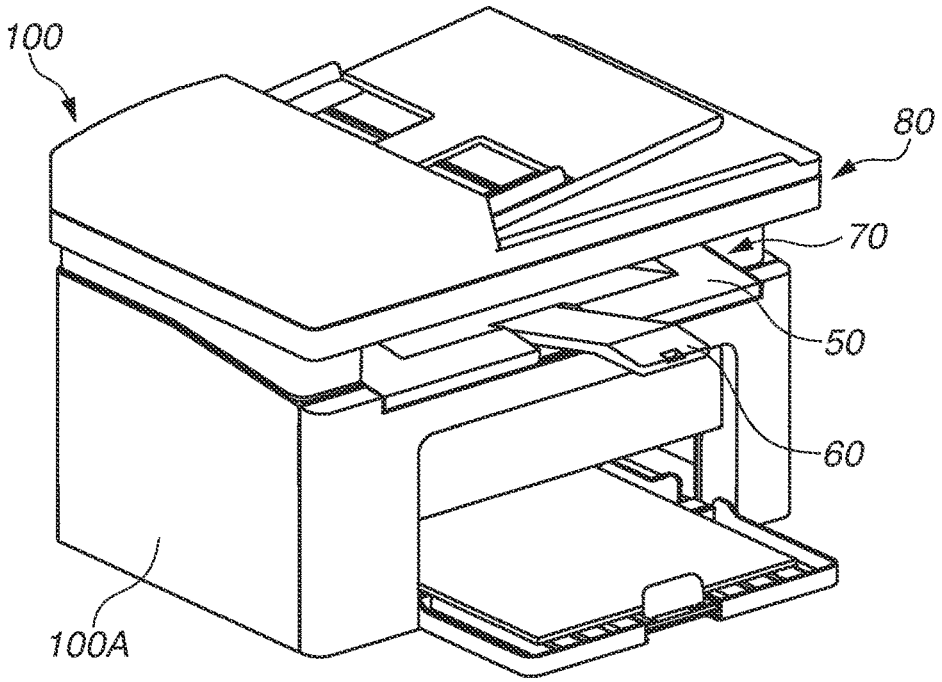
FIGS. 4A and 4B are perspective views illustrating an image forming apparatus including the sheet stacking device according to the first embodiment and an image reading apparatus.
Figure 4B:
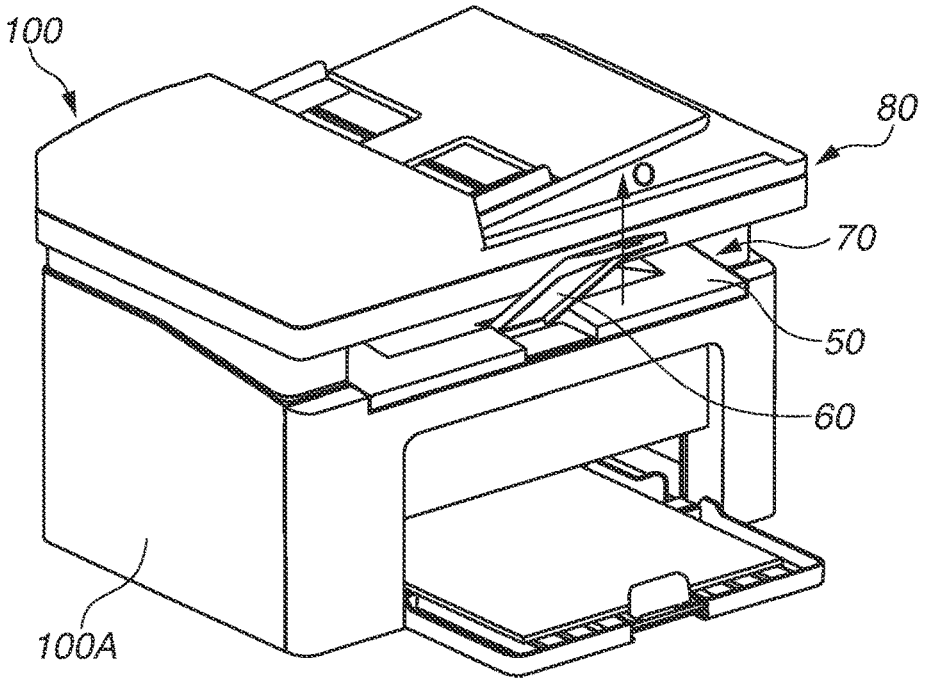

Meanwhile, there are cases in which an image reading apparatus (apparatus) is provided above the sheet stacking device 70 in the image forming apparatus 100. FIGS. 4A and 4B illustrate an example of an image forming apparatus (multi-function peripheral) in which an image reading apparatus 80 is provided above the sheet stacking device 70 according to the present embodiment. FIG. 4A is a perspective view illustrating the image forming apparatus 100 with the expansion tray 60 in the extension position. FIG. 4B is a perspective view illustrating the image forming apparatus 100 with the expansion tray 60 pivoted in the direction O opposite to the vertical direction V.

Figure 22A:
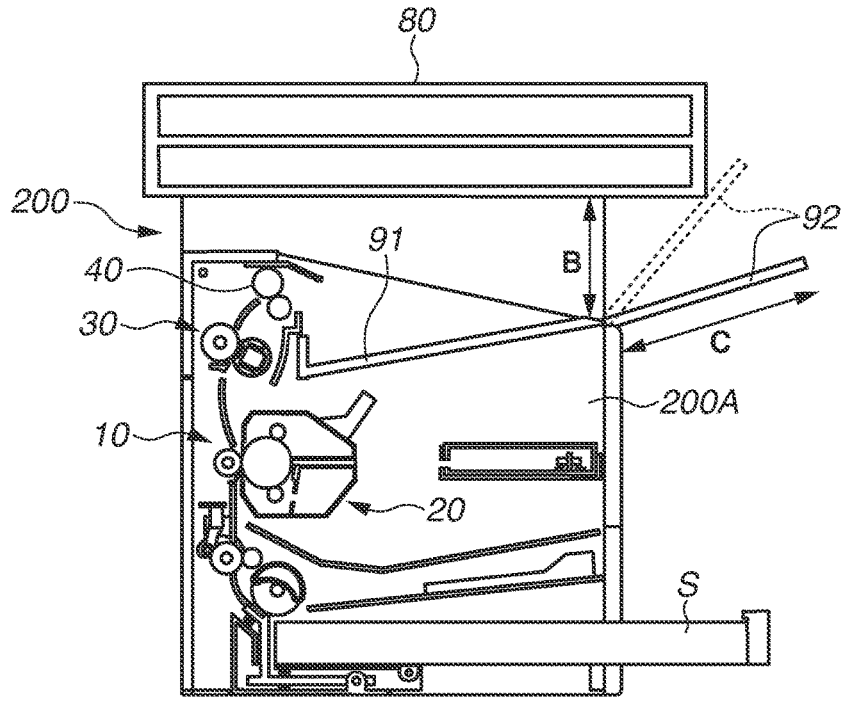
FIGS. 22A and 22B are cross sectional views illustrating a configuration of a conventional image forming apparatus.
Figure 22B:
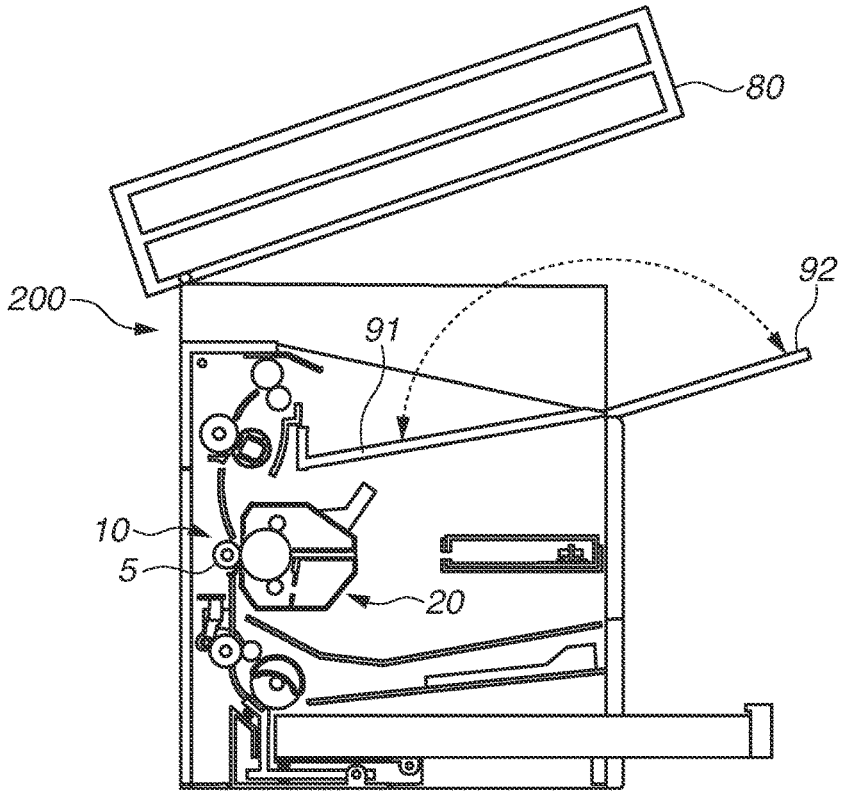

FIGS. 22A and 22B are cross sectional views schematically illustrating a configuration of the image forming apparatus 200 according to a comparative example in which the image reading apparatus 80 is provided above a tray 91.

In the image forming apparatus 200 according to the comparative example, a space B between the tray 91 and the image reading apparatus 80 may be set small in order to reduce the height of the image forming apparatus 200 (refer to FIG. 22A). In a case in which the expansion tray 92 provided to the tray 91 is to be rotated to open or close the expansion tray 92, unless the length C of the expansion tray 92 is shorter than the space B, the movement to open or close the expansion tray 92 with respect to the tray 91 cannot be performed freely (because the expansion tray 92 interferes with the image reading apparatus 80). On the other hand, if the length C of the expansion tray 92 is excessively short, there arises an issue that an original function of the expansion tray 92 cannot be performed, i.e., when a long sheet is discharged, a sufficient length for supporting the long sheet cannot be obtained.

In order to facilitate removal and attachment of the cartridge 20, the image reading apparatus 80 is pivotably attached to the apparatus body 200A as illustrated in FIG. 22B to obtain a sufficient length C of the expansion tray 92. However, in order to perform the movement to open or close the expansion tray 92 with respect to the tray 91, the image reading apparatus 80 needs to be pivoted, so if a document is on the image reading apparatus 80, the movement to open or close the expansion tray 92 cannot be performed.

In the image forming apparatus 200 according to the comparative example, the length C of the expansion tray 92 is short due to a constraint of the space B between the tray 91 and the image reading apparatus 80.

On the contrary, in the image forming apparatus 100 including the sheet stacking device 70 according to the present embodiment such as in FIGS. 4A and 4B, the expansion tray 60 is pulled and pivoted, so the expansion tray 60 can be pulled to a necessary length for stacking long sheets without the constraint such as in FIGS. 22A and 22B. Further, in the sheet stacking device 70 in a case of the image reading apparatus 80 being present, when the expansion tray 60 in the extension position is pivoted in the direction O opposite to the vertical direction V, the expansion tray 60 comes into contact with the image reading apparatus 80 to restrict the pivoting of the expansion tray 60 before the pivoting of the expansion tray 60 in the direction O is restricted by the rotation restriction unit Rr (e.g., in the first embodiment, the pair of groove portions 51*a* and the pair of pivot shafts 61 (FIGS. 2B and 2C)).

While the guide portion 51 is formed in the continuous integrated shape in the sheet stacking device 70 according to the present first embodiment (FIGS. 2A to 2D) to simplify the description, the shape of the guide portion 51 is not limited to the above shape. The guide portion 51 can be set discontinuously (e.g., there are cut portions) depending on molding conditions and parts shape optimization. Further, while the groove portion 51*a* is linearly formed in the sheet stacking device 70 according to the present embodiment, the groove portion 51*a* is not limited to the linear shape. For example, the groove portion 51*a* can be a curved line along a path along which the expansion tray 60 is pulled, or the groove portion 51*a* can include local protrusions and depressions.

Further, while the guide portion 51 is formed as a part of the tray 50, the guide portion 51 can be formed as a separate member from the tray 50. More specifically, a suitable shape can be selected within a range that rotation of the expansion tray 60 is restricted while the pivot shaft 61 is supported when the expansion tray 60 is in a position other than the extension position.

Another example of the sheet stacking device 70 will be described below.

A sheet stacking device 70 according to a second embodiment has a similar configuration to that of the sheet stacking device 70 according to the first embodiment, except that the rotation restriction unit Rr has a different configuration.

Figure 5A:
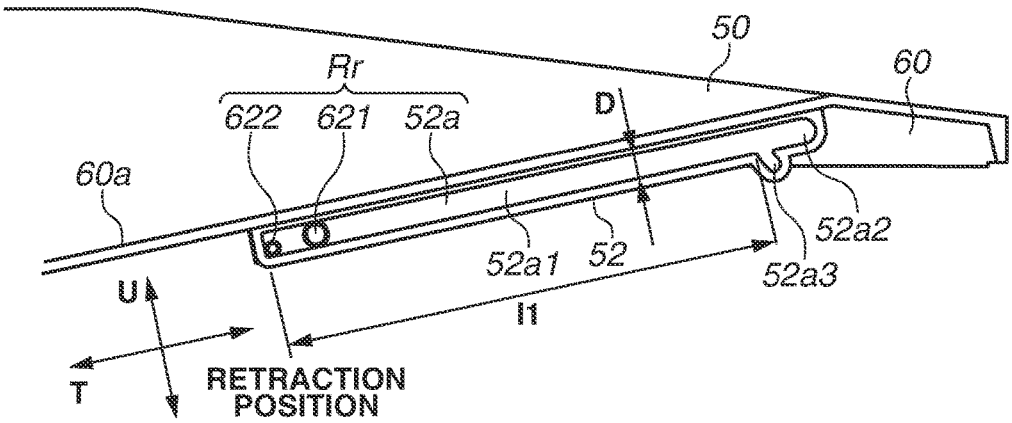
FIGS. 5A, 5B, and 5C illustrate a configuration and movement of a sheet stacking device according to a second embodiment.
Figure 5B:
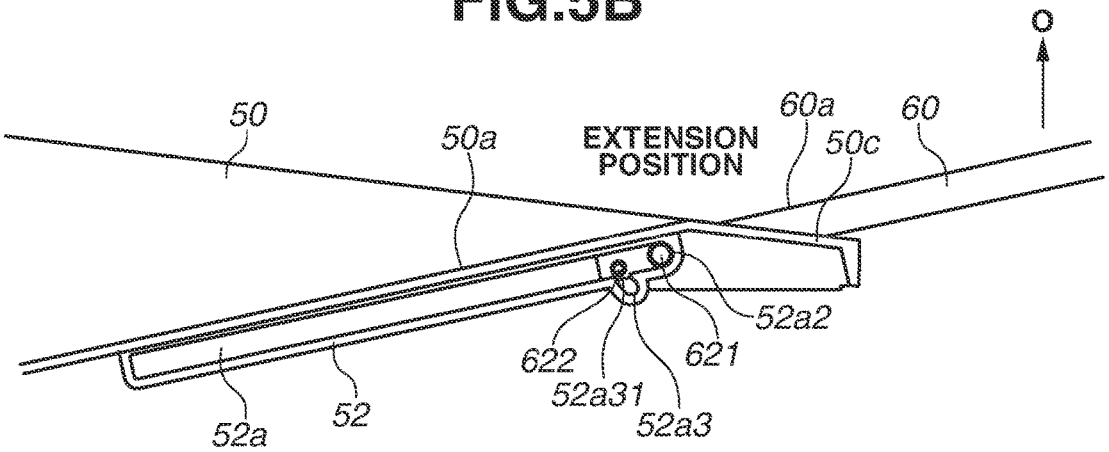
Figure 5C:
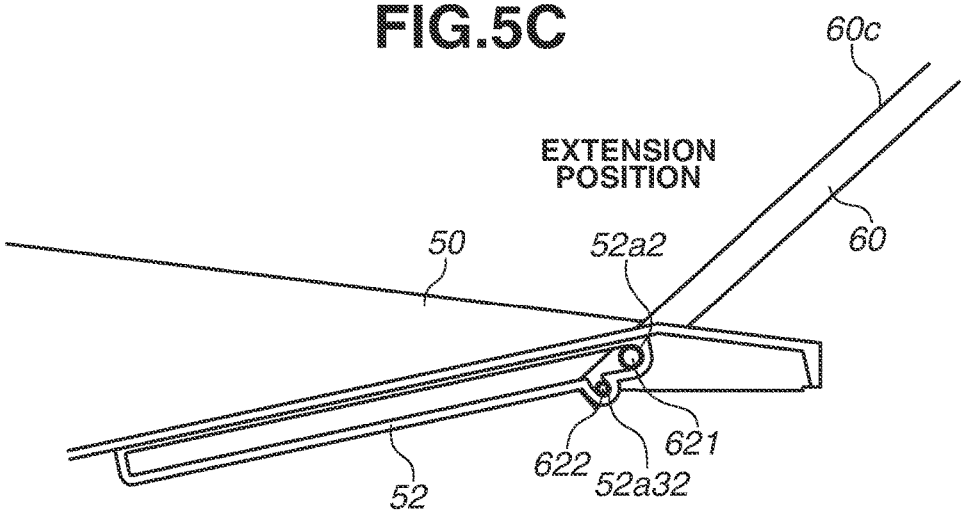

FIGS. 5A to 5C illustrate a configuration and movement of the sheet stacking device 70 according to the present embodiment. FIG. 5A is a cross sectional view illustrating the tray 50 and the expansion tray 60 in the retraction position. FIG. 5B is a cross sectional view illustrating the tray 50 and the expansion tray 60 in the extension position. FIG. 5C is a cross sectional view illustrating the tray 50 and the expansion tray 60 pivoted in the extension position in the direction O opposite to the vertical direction V.

The expansion tray 60 includes a pair of large-diameter cylindrical portions 621 (only one of the cylindrical portions 621 is illustrated in FIG. 5A) and a pair of small-diameter cylindrical portions 622 (only one of the cylindrical portions 622 is illustrated in FIG. 5A) having a smaller diameter than the diameter of the diameter cylindrical portions 621. The pair of large-diameter cylindrical portions 621 and the pair of small-diameter cylindrical portions 622 are provided to the lateral surfaces of the expansion tray 60. The two pairs of cylindrical portions 621 and 622 are provided on the rear edge portion side in a longitudinal direction of the expansion tray 60. In the present embodiment, the two pairs of cylindrical portions 621 and 622 are used in place of the pair of pivot shafts 61 according to the first embodiment.

The two pairs of cylindrical portions 621 and 622 are located at a predetermined distance from each other in the direction U which is orthogonal to the sheet stacking surface 60*a* of the expansion tray 60 and which is orthogonal to the direction T parallel to a direction in which the expansion tray 60 is moved. The large-diameter cylindrical portion 621 is provided on the pull direction side (right hand side in FIGS. 5A to 5C) of the expansion tray 60, and the small-diameter cylindrical portion 622 is provided on the push direction side (left hand side in FIGS. 5A to 5C) of the expansion tray 60.

A guide portion 52 includes a pair of groove portions 52*a* (only one of the groove portions 52*a* is illustrated in FIG. 5A) for guiding the large-diameter cylindrical portion 621 and the small-diameter cylindrical portion 622 from the retraction position to the extension position. The pair of groove portions 52*a*, the pair of large-diameter cylindrical portions 621, and the pair of small-diameter cylindrical portions 622 together form the rotation restriction unit Rr.

The groove portion 52*a* includes a first groove 52*a*1 and a second groove 52*a*2. The first groove 52*a*1 supports the large-diameter cylindrical portion 621 and the small-diameter cylindrical portion 622 in such a manner that the large-diameter cylindrical portion 621 and the small-diameter cylindrical portion 622 can be moved in the section I1 from the retraction position to a position before the extension position. The second groove 52*a*2 supports the large-diameter cylindrical portion 621 in such a manner that the large-diameter cylindrical portion 621 can be pivoted in the extension position. The second groove 52*a*2 serves as a pivot center of the expansion tray 60. The groove portion 52*a* further includes a third groove 52*a*3 into which the small-diameter cylindrical portion 622 is to be moved in a position between the section I1 and the extension position.

In the retraction position, peripheral surfaces of the large-diameter cylindrical portion 621 and the small-diameter cylindrical portion 622 come into contact with the first groove 52*a*1 in the section I1 (refer to FIG. 5A). In the region of the section I1 that is on the right hand side of the retraction position, the peripheral surfaces of the large-diameter cylindrical portion 621 and the small-diameter cylindrical portion 622 are in contact with the first groove 52*a*1. The width D of the first groove 52*a*1 is set substantially equal to the diameter of the large-diameter cylindrical portion 621. Thus, in the section I1, the large-diameter cylindrical portion 621 and the small-diameter cylindrical portion 622 are movably supported by the first groove 52*a*1 so that the expansion tray 60 can be moved along the first groove 52*a*1.

In the extension position, the large-diameter cylindrical portion 621 fits in the second groove 52*a*2. Further, in the extension position, the small-diameter cylindrical portion 622 is located directly above an inlet 52*a*31 of the third groove 52*a*3.

Then, when the expansion tray 60 is pivoted in the direction O opposite to the vertical direction V on the large-diameter cylindrical portion 621 fitting in the second groove 52*a*2 in the extension position, the small-diameter cylindrical portion 622 is moved into the third groove 52*a*3. Then, as the expansion tray 60 is further pivoted in the direction O, the small-diameter cylindrical portion 622 comes into contact with a bottom portion 52*a*32 of the third groove 52*a*3 to stop the pivoting of the expansion tray 60 in the direction O. Thus, the expansion tray 60 can be pivoted on the large-diameter cylindrical portion 621 in the direction O opposite to the vertical direction V within a predetermined range (predetermined angle). The predetermined angle of pivoting of the expansion tray 60 is desirably 20 degrees to 90 degrees with respect to the expansion position in the direction O opposite to the vertical direction V.

Also in the sheet stacking device 70 according to the present embodiment, the expansion tray 60 can be pulled from and pushed into the tray 50, and the expansion tray 60 is supported by the tray 50 in such a manner that the expansion tray 60 can be pivoted in the direction O opposite to the vertical direction V. The direction in which the expansion tray 60 is pivoted in the direction O opposite to the vertical direction V is the same as the direction in which the tray 50 is pivoted from the closed position to the opened position.

Accordingly, a similar benefit to that of the sheet stacking device 70 according to the first embodiment is produced.

While the third groove 52*a*3 is shaped to branch from the first groove 52*a*1 and include the bottom portion 52*a*32 in a closed shape in the sheet stacking device 70 according to the present embodiment, the third groove 52*a*3 can be in a cut portion with the bottom portion 52*a*32 being opened. Further, while the cylindrical portions 621 and 622 are provided to the expansion tray 60, this is not a limiting case, and the cylindrical portions 621 and 622 can be different parts. In other words, the shapes of the cylindrical portions 621 and 622 can be changed as appropriate to an extent that the above-described benefit is produced.

Further, while the pivot center of the expansion tray 60 is set on the tray 50 in the present embodiment, the pivot center can be set on the expansion tray 60. The pivot center of the expansion tray 60 can be is set in a position closer to an upstream edge of the expansion tray 60 than a downstream edge of the expansion tray 60 in the discharge direction X.

Yet another example of the sheet stacking device 70 will be described below.

A sheet stacking device 70 according to a third embodiment has a similar configuration to that of the sheet stacking device 70 according to the first embodiment, except that the rotation restriction unit Rr has a different configuration.

Figure 6:
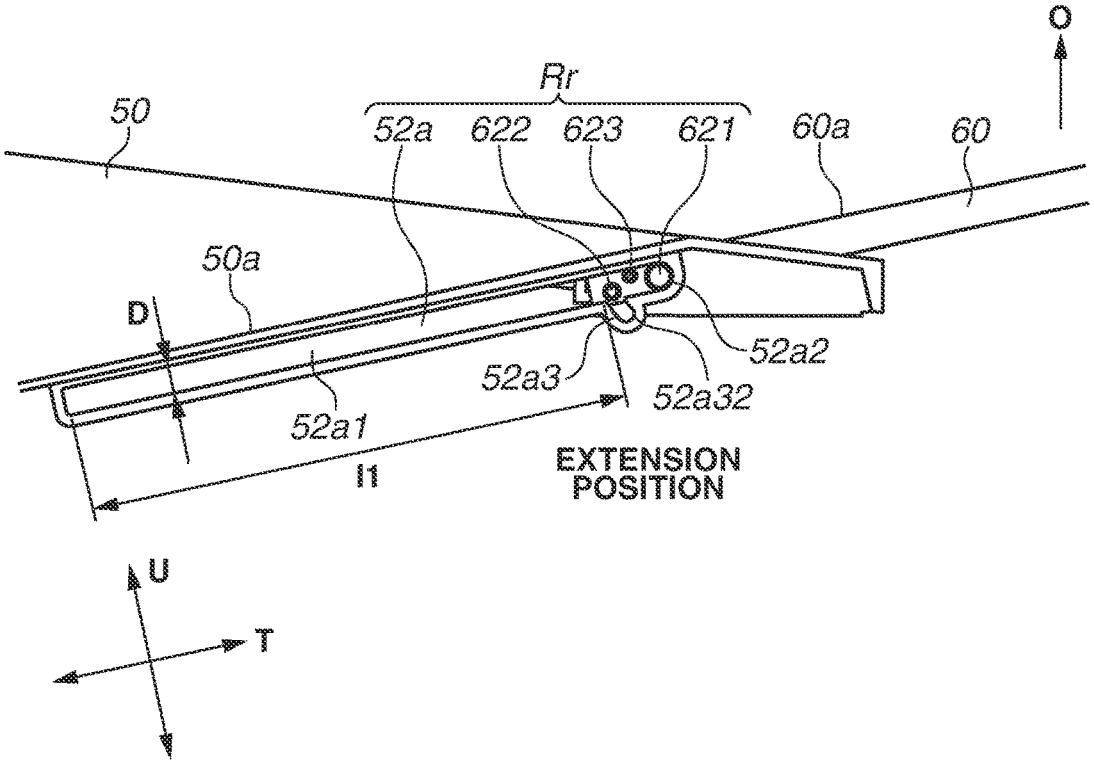
FIG. 6 illustrates a configuration of a sheet stacking device according to a third embodiment.

FIG. 6 illustrates a configuration and movement of the sheet stacking device 70 according to the present embodiment. FIG. 6 is a cross sectional view illustrating the tray 50 and the expansion tray 60 in the extension position.

The expansion tray 60 includes the pair of large-diameter cylindrical portions 621 (only one of the cylindrical portions 621 is illustrated in FIG. 6) and the pair of small-diameter cylindrical portions 622 (only one of the cylindrical portions 622 is illustrated in FIG. 5A) having a smaller diameter than the diameter of the large-diameter cylindrical portions 621. The pair of large-diameter cylindrical portions 621 and the pair of small-diameter cylindrical portions 622 are provided to the lateral surfaces of the expansion tray 60. The expansion tray 60 further includes a pair of smallest-diameter cylindrical portion 623 (only one of the cylindrical portion 623 is illustrated in FIG. 6) having a smaller diameter than the diameter of the small-diameter cylindrical portions 622.

The three pairs of cylindrical portions 621, 622, and 623 are provided on the rear edge portion side in the longitudinal direction of the expansion tray 60. In the present embodiment, the three pairs of cylindrical portions 621, 622, and 623 are used in place of the pivot shafts 61 according to the first embodiment.

The three pairs of cylindrical portions 621, 622, and 623 are located at a predetermined distance from each other in the direction U which is orthogonal to the sheet stacking surface 60*a* of the expansion tray 60 and which is orthogonal to the direction T parallel to the direction in which the expansion tray 60 is moved. The large-diameter cylindrical portion 621 is provided on the pull direction side (right hand side in FIG. 6) of the expansion tray 60, the small-diameter cylindrical portion 622 on the push direction side (left hand side in FIG. 6) of the expansion tray 60, and the smallest-diameter cylindrical portion 623 between the large-diameter cylindrical portion 621 and the small-diameter cylindrical portion 622.

The guide portion 52 includes the pair of groove portions 52*a* (only one of the groove portions 52*a* is illustrated in FIG. 6) for guiding the large-diameter cylindrical portions 621, the small-diameter cylindrical portions 622, and the smallest-diameter cylindrical portions 623 from the retraction position to the extension position. The pair of groove portions 52*a*, the pair of large-diameter cylindrical portions 621, the pair of small-diameter cylindrical portions 622, and the pair of smallest-diameter cylindrical portions 623 together form the rotation restriction unit Rr.

The groove portion 52*a* includes the first groove 52*a*1 that supports the large-diameter cylindrical portion 621, the small-diameter cylindrical portion 622, and the smallest-diameter cylindrical portion 623 in such a manner that the large-diameter cylindrical portion 621, the small-diameter cylindrical portion 622, and the smallest-diameter cylindrical portion 623 can be moved in the section I1 from the retraction position to a position before the extension position. The groove portion 52*a* further includes the second groove 52*a*2 that supports the smallest-diameter cylindrical portion 623 and also supports the large-diameter cylindrical portion 621 in such a manner that the large-diameter cylindrical portion 621 can be pivoted in the extension position. The second groove 52*a*2 is the pivot center of the expansion tray 60. The groove portion 52*a* further includes the third groove 52*a*3 into which the small-diameter cylindrical portion 622 is to be moved in the position between the section I1 and the extension position.

In the retraction position and the region of the section I1 that is on the right hand side of the retraction position, peripheral surfaces of the large-diameter cylindrical portion 621, the small-diameter cylindrical portion 622, and the smallest-diameter cylindrical portion 623 come into contact with the first groove 52*a*1. The width D of the first groove 52*a*1 is set substantially equal to the diameter of the large-diameter cylindrical portion 621. Thus, the large-diameter cylindrical portion 621, the small-diameter cylindrical portion 622, and the smallest-diameter cylindrical portion 623 are movably supported by the first groove 52*a*1 so that the expansion tray 60 can be moved along the first groove 52*a*1.

In the extension position, the large-diameter cylindrical portion 621 fits in the second groove 52*a*2. Further, in the extension position, the small-diameter cylindrical portion 622 is located directly above an inlet 52*a*31 of the third groove 52*a*3. Further, in the extension position, a part of the peripheral surface of the smallest-diameter cylindrical portion 623 is in contact with the second groove 52*a*2.

Then, when the expansion tray 60 is pivoted in the direction O opposite to the vertical direction V on the large-diameter cylindrical portion 621 fitting in the second groove 52*a*2 in the extension position, the small-diameter cylindrical portion 622 is moved into the third groove 52*a*3. Then, as the expansion tray 60 is further pivoted in the direction O, the small-diameter cylindrical portion 622 comes into contact with the bottom portion 52*a*32 of the third groove 52*a*3 to stop the pivoting of the expansion tray 60 in the direction O. Thus, the expansion tray 60 can be pivoted on the large-diameter cylindrical portion 621 in the direction O opposite to the vertical direction V within a predetermined range.

Also in the sheet stacking device 70 according to the present embodiment, the expansion tray 60 can be pulled from and pushed into the tray 50, and the expansion tray 60 is supported by the tray 50 in such a manner that the expansion tray 60 can be pivoted in the direction O opposite to the vertical direction V. Accordingly, a similar benefit to that of the sheet stacking device 70 according to the first embodiment is produced. In the sheet stacking device 70 according to the present embodiment, a part of the peripheral surface of the smallest-diameter cylindrical portion 623 is in contact with the second groove 52*a*2 to produce a benefit that the orientation (orientation of the expansion tray 60 before being pivoted) of the expansion tray 60 with respect to the tray 50 in the extension position is stabilized.

While the third groove 52*a*3 is shaped to branch from the first groove 52*a*1 and include the bottom portion 52*a*32 in a closed shape in the sheet stacking device 70 according to the present embodiment, the third groove 52*a*3 can be in a cut portion with the bottom portion 52*a*32 being opened. Further, while the cylindrical portions 621, 622, and 623 are provided to the expansion tray 60, this is not a limiting case, and the cylindrical portions 621, 622, and 623 can be different parts. In other words, the shapes of the cylindrical portions 621, 622, and 623 can be changed as appropriate to an extent that the above-described benefit is produced.

Yet another example of the sheet stacking device 70 will be described below.

A sheet stacking device 70 according to a fourth embodiment has a similar configuration to that of the sheet stacking device 70 according to the first embodiment, except that the rotation restriction unit Rr has a different configuration.

Figure 7:
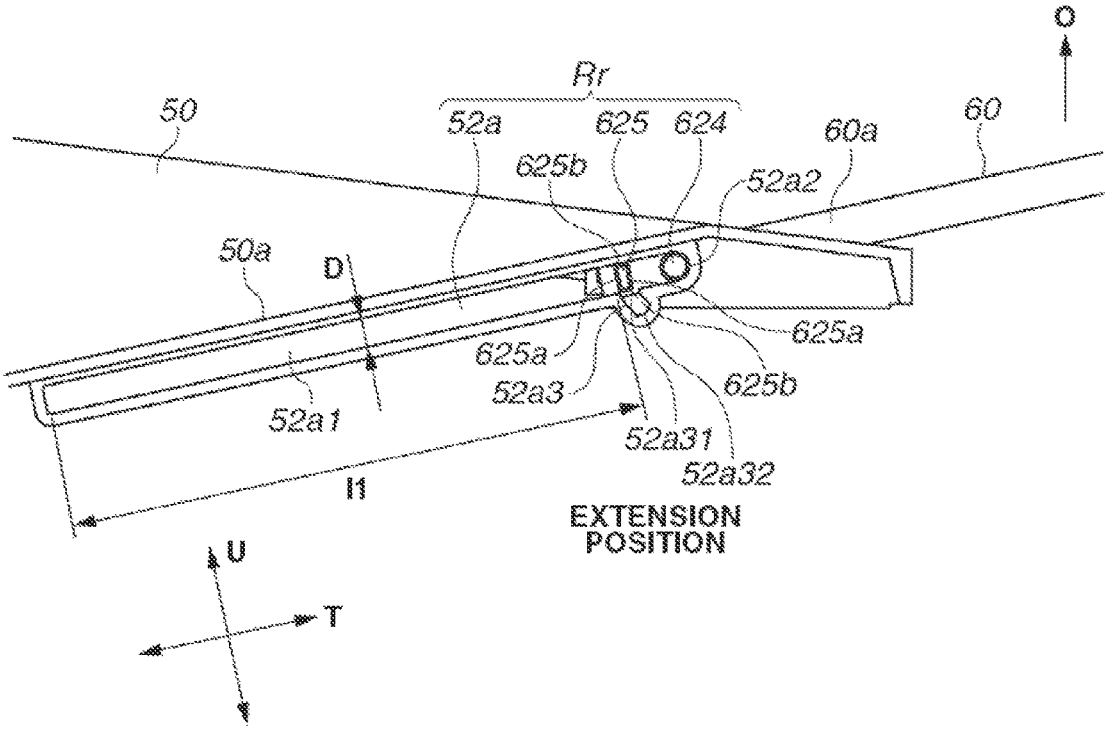
FIG. 7 illustrates a configuration of a sheet stacking device according to a fourth embodiment.

FIG. 7 illustrates a configuration and movement of the sheet stacking device 70 according to the present embodiment. FIG. 7 is a cross sectional view illustrating the tray 50 and the expansion tray 60 in the extension position.

The expansion tray 60 includes a pair of cylindrical portions 624 (only one of the cylindrical portions 624 is illustrated in FIG. 7) provided to the lateral surfaces of the expansion tray 60. The expansion tray 60 further includes a pair of cylindrical portions 625 (only one of the cylindrical portions 625 is illustrated in FIG. 7) having a two-side chamfered shape to be smaller than the diameter of the cylindrical portions 624. More specifically, the cylindrical portion 625 includes flat surface portions 625*a* in two parts in the direction T, which is parallel to the pull direction of the expansion tray 60, and arc-shaped portions 625*b* in two parts in the direction U, which is orthogonal to the sheet stacking surface 60*a* of the expansion tray 60.

The pairs of cylindrical portions 624 and 625 are provided on the rear edge portion side in the longitudinal direction of the expansion tray 60. In the present embodiment, the two pairs of cylindrical portions 624 and 625 are used in place of the pivot shafts 61 according to the first embodiment.

The pair of cylindrical portions 624 is provided on the pull direction side (right hand side in FIG. 7) of the expansion tray 60, and the pair of cylindrical portions 625 is provided on the push direction side (left hand side in FIG. 7) of the expansion tray 60.

The guide portion 52 includes the pair of groove portions 52*a* (only one of the groove portions 52 is illustrated in FIG. 7) for guiding the cylindrical portions 624 and 625 from the retraction position to the extension position. The pair of groove portions 52*a*, the pair of cylindrical portions 624, and the pair of cylindrical portions 625 together form the rotation restriction unit Rr.

The groove portion 52*a* includes the first groove 52*a*1 and the second groove 52*a*2. The first groove 52*a*1 supports the cylindrical portions 624 and 625 in such a manner that the cylindrical portions 624 and 625 can be moved in the section I1 from the retraction position to a position before the extension position. The second groove 52*a*2 supports the cylindrical portion 624 in such a manner that the cylindrical portion 624 can be pivoted in the extension position. The groove portion 52*a* further includes the third groove 52*a*3 into which the cylindrical portion 625 is to be moved in the position between the section I1 and the extension position.

In the retraction position, peripheral surfaces of the cylindrical portion 624 and the flat surface portions 625*a* and the arc-shaped portions 625*b* of the cylindrical portion 625 come into contact with the first groove 52*a*1 in the section I1. In a region of the section I1 that is on the right hand side of the retraction position, the peripheral surfaces of the cylindrical portion 624 and the arc-shaped portions 625*b* of the cylindrical portion 625 are in contact with the first groove 52*a*1. The width D of the first groove 52*a*1 is set substantially equal to the diameter of the cylindrical portions 624 and 625. Thus, the cylindrical portions 624 and 625 are movably supported by the first groove 52*a*1 so that the expansion tray 60 can be moved along the first groove 52*a*1.

In the extension position, the cylindrical portion 624 fits in the second groove 52*a*2. Further, in the extension position, the cylindrical portion 625 is located directly above the inlet 52*a*31 of the third groove 52*a*3. Further, in the extension position, the arc-shaped portions 625*b* of the cylindrical portions 625 are in contact with the second groove 52*a*2.

Then, when the expansion tray 60 is pivoted in the direction O opposite to the vertical direction V on the cylindrical portion 624 fitting in the second groove 52*a*2 in the extension position, the flat surface portions 625*a* of the cylindrical portion 625 are moved into the third groove 52*a*3. Then, as the expansion tray 60 is further pivoted in the direction O, the arc-shaped portions 625*b* of the cylindrical portion 625 come into contact with the bottom portion 52*a*32 of the third groove 52*a*3 to stop the pivoting of the expansion tray 60 in the direction O. Thus, the expansion tray 60 can be pivoted on the cylindrical portion 624 in the direction O opposite to the vertical direction V within a predetermined range.

Also in the sheet stacking device 70 according to the present embodiment, the expansion tray 60 can be pulled from and pushed into the tray 50, and the expansion tray 60 is supported by the tray 50 in such a manner that the expansion tray 60 can be pivoted in the direction O opposite to the vertical direction V. Accordingly, a similar benefit to that of the sheet stacking device 70 according to the first embodiment is produced. Similar to the third embodiment (FIG. 6), in the sheet stacking device 70 according to the present fourth embodiment (FIG. 7), a part of one arc-shaped portion 625*b* of a cylindrical portion 625 is in contact with the second groove 52*a*2 to produce a benefit that the orientation (orientation of the expansion tray 60 before being pivoted) of the expansion tray 60 with respect to the tray 50 in the extension position is stabilized.

While the third groove 52*a*3 is shaped to branch from the first groove 52*a*1 and include the bottom portion 52*a*32 in a closed shape in the sheet stacking device 70 according to the present embodiment, the third groove 52*a*3 can be in a cut portion with the bottom portion 52*a*32 being opened. Further, while the cylindrical portions 624 and 625 are provided to the expansion tray 60, this is not a limiting case, and the cylindrical portions 624 and 625 can be different parts. In other words, the shapes of the cylindrical portions 624 and 625 can be changed as appropriate to an extent that the above-described benefit is produced.

A sheet stacking device 70 according to a fifth embodiment will be described below.

In the present embodiment, components that are similar to those of the sheet stacking device 70 according to the first embodiment are given the same reference numerals, and description of the components is omitted.

The tray 50 and the expansion tray 60 connected to the tray 50 will be described with reference to FIGS. 8A and 8B.

Figure 8A:
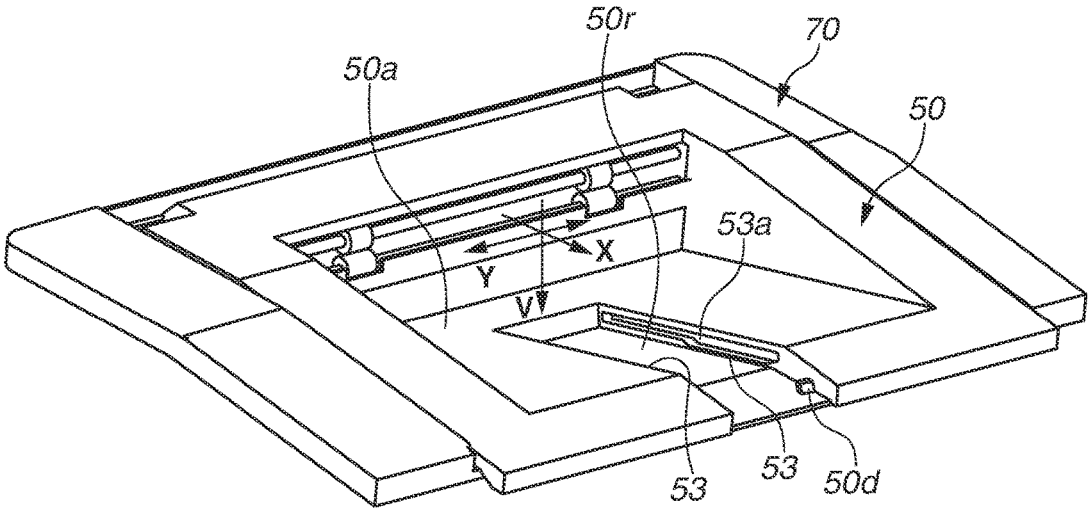
FIGS. 8A and 8B illustrate a configuration of a sheet stacking device according to a fifth embodiment.

FIG. 8A is a perspective view illustrating the tray 50 provided in the upper portion of the apparatus body 100A. FIG. 8B is a perspective view illustrating the expansion tray 60 viewed from the front edge portion 60*c* side.

As illustrated in FIG. 8A, the tray 50 includes an attachment portion 50*r* for attaching the expansion tray 60 on the front edge portion 50*c* side of the sheet stacking surface 50*a* and the front edge portion side of the tray 50 in the discharge direction X. The attachment portion 50*r* is provided in a central region in the width direction Y of the tray 50.

In the width direction Y of the tray 50, a pair of guide portions 53 is provided to lateral surfaces of the attachment portion 50*r*. The pair of guide portions 53 is provided to guide the expansion tray 60. The pair of guide portions 53 includes groove portions 53*a* for guiding a pair of pivot shafts (shafts) 63, which will be described below, of the expansion tray 60 from the retraction position to the extension position. The pair of groove portions 53*a* and the pair of pivot shafts 63 together form the rotation restriction unit Rr.

Figure 8B:
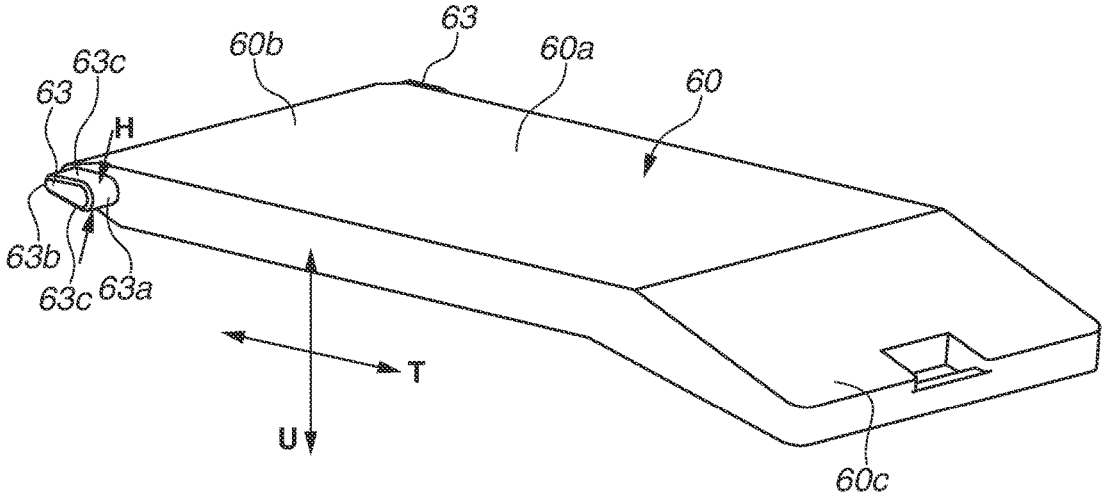

As illustrated in FIG. 8B, the expansion tray 60 is a member that is long in the discharge direction X (refer to FIG. 8A). The expansion tray 60 includes the pair of pivot shafts 63 on the rear edge portion 60*b* side in the longitudinal direction of the expansion tray 60. The pair of pivot shafts 63 is provided to pivotably support the expansion tray 60 on the tray 50. The pair of pivot shafts 63 is provided to the lateral surfaces of the expansion tray 60 in the width direction Y.

The pair of pivot shafts 63 includes arc portions 63*a* on the front edge portion 60*c* side of the expansion tray 60 on a rotation shaft. The pair of pivot shafts 63 has a predetermined radius in the direction U which is orthogonal to the direction T parallel to the pull direction of the expansion tray 60 and which is orthogonal to the sheet stacking surface 60*a* of the expansion tray 60.

The pair of pivot shafts 63 further includes projection portions 63*b* on the rear edge portion 60*b* side of the expansion tray 60 on the rotation shaft. The projection portions 63*b* each have a predetermined radius in the direction U which is orthogonal to the direction T parallel to the pull direction of the expansion tray 60 and the sheet stacking surface 60*a* of the expansion tray 60. The radius of the projection portions 63*b* is smaller than the arc portions 63*a*.

The pair of pivot shafts 63 further includes between the arc portions 63*a* and the projection portions 63*b* two flat surface portions 63*c* connecting the arc portions 63*a* and the projection portions 63*b*.

FIGS. 9A to 9D illustrate the connection structure of the tray 50 and the expansion tray 60 and movement of the expansion tray 60. The pair of guide portions 53 has the same configuration, and the pair of pivot shafts 63 has the same configuration, so only one of the pair of guide portions 53 and one of the pair of pivot shafts 63 will be described below.

Figure 9A:
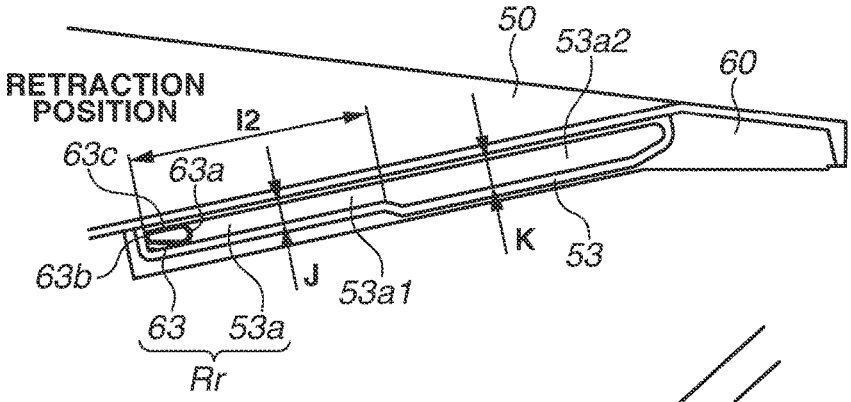
FIGS. 9A, 9B, 9C, and 9D illustrate movement of the sheet stacking device according to the fifth embodiment.
Figure 9B:
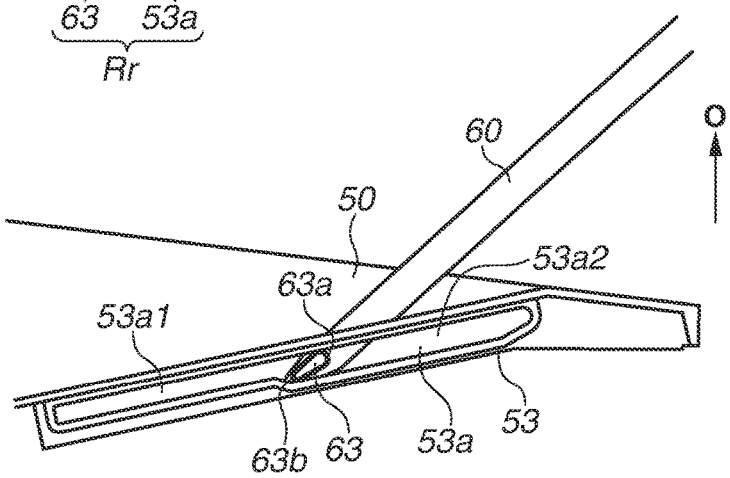
Figure 9C:
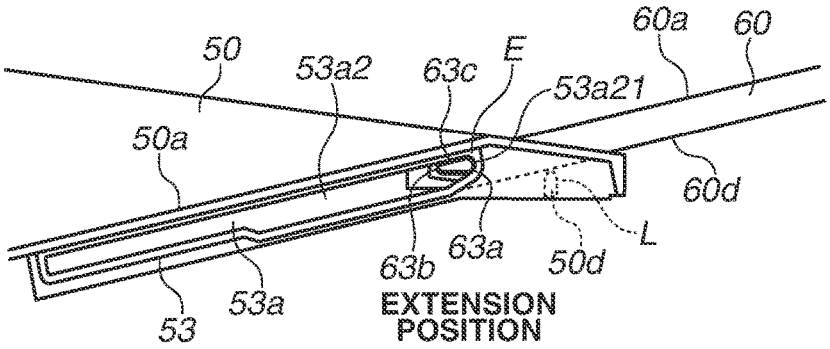
Figure 9D:
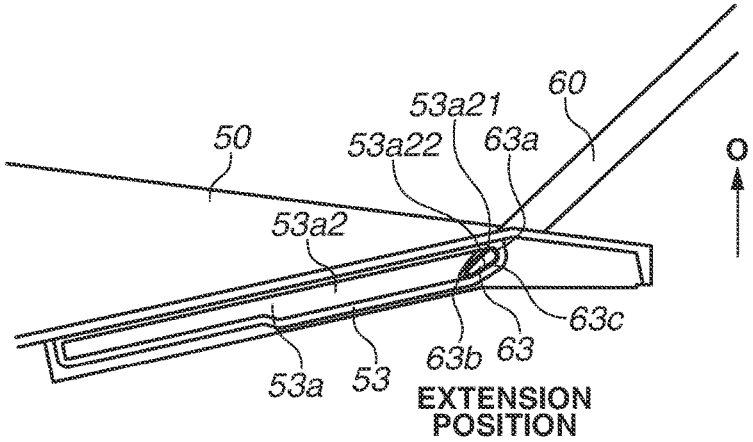

FIG. 9A is a cross sectional view illustrating the tray 50 and the expansion tray 60 in the retraction position. FIG. 9B is a cross sectional view illustrating the tray 50 and the expansion tray 60 pivoted in the direction O opposite to the vertical direction V in a position beyond a section I2. FIG. 9C is a cross sectional view illustrating the tray 50 and the expansion tray 60 in the extension position. FIG. 9D is a cross sectional view illustrating the tray 50 and the expansion tray 60 which is in the extension position and is pivoted in the direction O opposite to the vertical direction V.

The groove portion 53*a* includes a first groove 53*a*1 that supports the pivot shaft 63 in such a manner that the pivot shaft 63 can be moved in the predetermined section I2 from the retraction position to a position before the extension position. The groove portion 53*a* further includes a second groove 53*a*2 which pivotably supports the pivot shaft 63 in a region beyond the section I2 and up to the extension position.

In the retraction position, a peripheral surface of the projection portion 63*b*, the flat surface portion 63*c*, and a part of a peripheral surface of the arc portion 63*a* of the pivot shaft 63 come into contact with the first groove 53*a*1 in the section I2. In a region of the section I2 that is on the right hand side of the retraction position, the peripheral surface of the arc portion 63*a* of the pivot shaft 63 is in contact with the first groove 53*a*1. The width J of the first groove 53*a*1 is set substantially equal to the diameter of the arc portion 63*a* of the pivot shaft 63. Thus, the pivot shaft 63 fits in the first groove 53*a*1. Accordingly, in the section I2, the pivot shaft 63 is movably supported by the first groove 53*a*1 so that the expansion tray 60 can be moved along the first groove 53*a*1.

The width K of the second groove 53*a*2 is greater than the first groove 53*a*1. The width K is set to the size of an area in which the arc portion 63*a* and the projection portion 63*b* of the pivot shaft 63 are both in contact with the second groove 53*a*2. Thus, in the region beyond the section I2 and up to the extension position, the expansion tray 60 can be pivoted in the direction O opposite to the vertical direction V within a predetermined range after the arc portion 63*a* of the pivot shaft 63 comes into contact with the second groove 53*a*2 and until the projection portion 63*b* comes into contact with the second groove 53*a*2.

In the extension position, the arc portion 63*a* of the pivot shaft 63 fits in a semi-circular arc depressed portion 53*a*21 of the second groove 53*a*2, and the flat surface portion 63*c* and a part of the peripheral surface of the projection portion 63*b* of the pivot shaft 63 are in contact with the second groove 53*a*2 (refer to the first contact portion E in FIG. 9C). Further, in the extension position, the back surface 60*d* of the expansion tray 60 is in contact with the projection portion 50*d* of the tray 50 in the central region of the tray 50 (refer to a second contact portion L in FIG. 9C). In this way, the expansion tray 60 is supported in stable orientation in the extension position by the second groove 53*a*2 to allow stable stacking of long sheets.

If the expansion tray 60 in the extension position is pivoted in the direction O opposite to the vertical direction V by a user, the arc portion 63*a* of the pivot shaft 63 is pivoted with respect to the depressed portion 53*a*21 of the second groove 53*a*2. If the expansion tray 60 is further pivoted in the direction O, the flat surface portion 63*c* and a part of the peripheral surface of the projection portion 63*b* of the pivot shaft 63 come into contact with an end surface 53*a*22 of the second groove 53*a*2 to stop the pivoting of the expansion tray 60 in the direction O. Thus, the expansion tray 60 becomes pivotable on the pivot shaft 63 in the direction O opposite to the vertical direction V within a predetermined range.

More specifically, in the section I2, the pivoting of the expansion tray 60 in the direction O opposite to the vertical direction V is restricted, and in the region beyond the section I2 and up to the extension position, the expansion tray 60 can be pivoted in the direction O opposite to the vertical direction V.

The pivoting of the expansion tray 60 in the vertical direction V in the extension position is restricted at two points that are the second contact portion F and the first contact portion E.

To retract the expansion tray 60 into the tray 50, the expansion tray 60 is pushed into the tray 50 in the region beyond the section I2 and up to the extension position.

In the sheet stacking device 70 according to the present embodiment, the expansion tray 60 can be pulled from and pushed into the tray 50. Further, the expansion tray 60 is supported by the tray 50 in such a manner that the expansion tray 60 can be pivoted in the direction O opposite to the vertical direction V. Accordingly, a similar benefit to that of the first embodiment is produced. Further, in the region beyond the section I2 and up to the extension position, the expansion tray 60 can be pivoted in the direction O opposite to the vertical direction V. Thus, the expansion tray 60 can be moved and rotated with respect to the tray 50 with ease, compared to the first embodiment.

Further, in the sheet stacking device 70 according to the present embodiment, even if the user accidentally moves or pushes the expansion tray 60 upward, the tray 50 remains at rest.

Figure 10A:
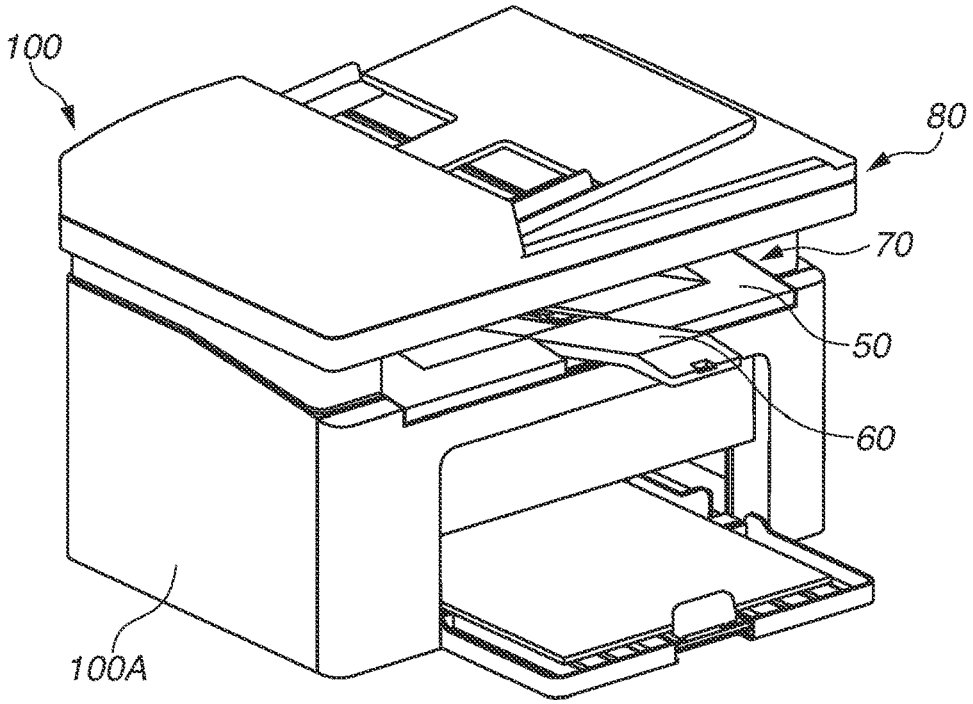
FIGS. 10A and 10B are perspective views illustrating an image forming apparatus including the sheet stacking device according to the fifth embodiment and an image reading apparatus.
Figure 10B:
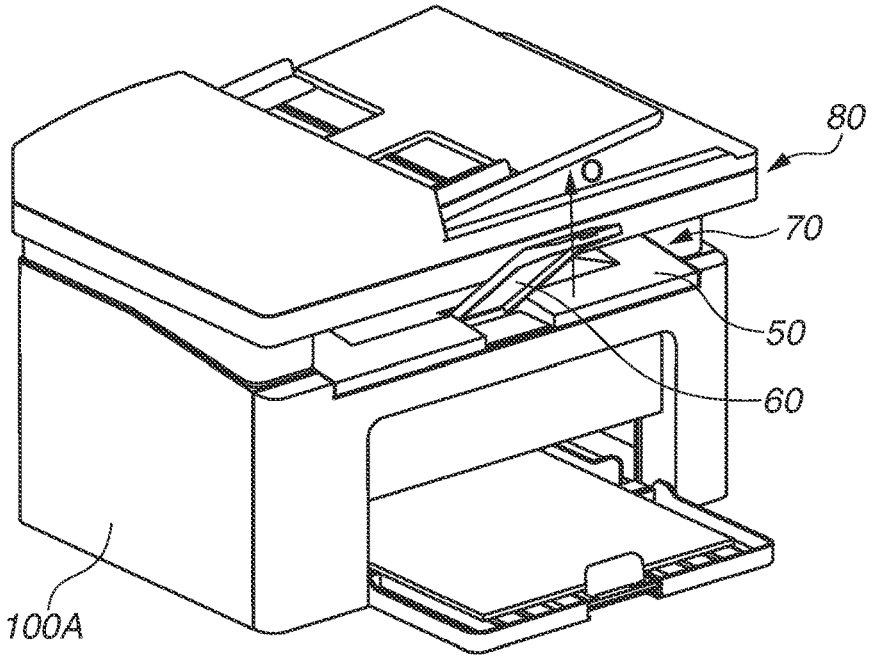

FIGS. 10A and 10B illustrate an example of the image forming apparatus (multi-function peripheral) 100 including the image reading apparatus 80 provided above the sheet stacking device 70 according to the present embodiment. FIG. 10A is a perspective view illustrating the image forming apparatus 100 with the expansion tray 60 in the extension position. FIG. 10B is a perspective view illustrating the image forming apparatus 100 with the expansion tray 60 pivoted in the direction O opposite to the vertical direction V.

In the image forming apparatus 100 including the sheet stacking device 70 according to the present embodiment, the expansion tray 60 is pulled and pivoted, so the expansion tray 60 can be pulled to a necessary length for stacking long sheets without the constraint described in the first embodiment. Further, in the sheet stacking device 70, when the expansion tray 60 in the extension position is pivoted in the direction O opposite to the vertical direction V, the expansion tray 60 comes into contact with the image reading apparatus 80 to restrict the pivoting of the expansion tray 60 before the pivoting of the expansion tray 60 in the direction O is restricted by the rotation restriction unit Rr.

Further, in the region beyond the section I2 and up to the extension position, the expansion tray 60 of the sheet stacking device 70 can be pivoted in the direction O opposite to the vertical direction V. Thus, in the image forming apparatus 100 including the sheet stacking device 70 according to the present embodiment, the expansion tray 60 can be pulled and pushed smoothly during printing operations.

Figure 11:
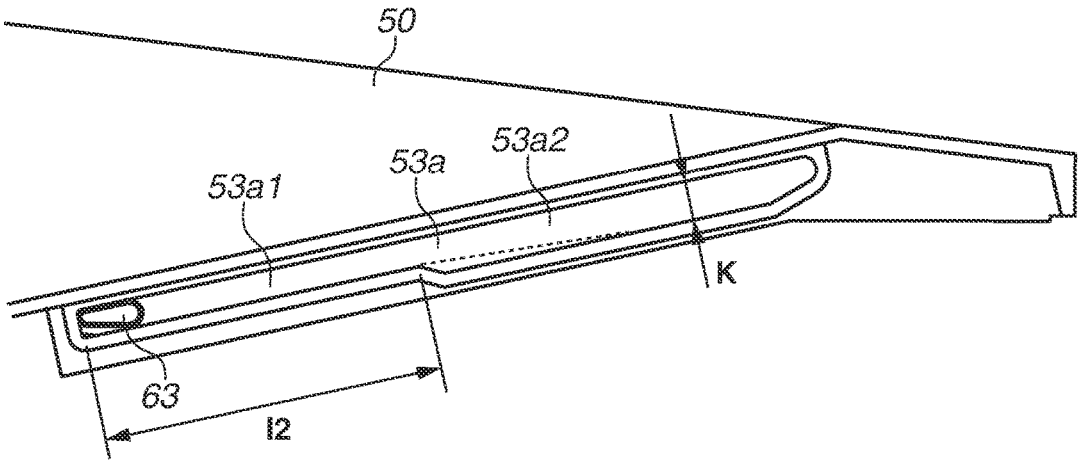
FIG. 11 illustrates a modified example of a groove portion of a tray of the sheet stacking device according to the fifth embodiment.

FIG. 11 illustrates a modified example of the groove portion 53*a* of the tray 50 of the sheet stacking device 70 according to the fifth embodiment. While the width K of the second groove 53*a*2 in the region beyond the section I2 and up to the extension position in the groove portion 53*a* of the guide portion 53 illustrated in FIG. 9A is constant, the width K can be changed as appropriate. As illustrated in FIG. 11, the width K of the second groove portion 53*a*2 is changed as specified by a broken line in such a manner that the width K is asymptotically reduced toward the first groove 53*a*1. In this way, the pivot angle of the expansion tray 60 can be changed according to the position of the pivot shaft 63.

Further, the position of the section I2 of the first groove 53*a*1 for restricting the pivoting of the expansion tray 60 and the number of sections I2 can be determined as appropriate for the type of usage.

Yet another example of the sheet stacking device 70 will be described below.

A sheet stacking device 70 according to a sixth embodiment has a similar configuration to that of the sheet stacking device 70 according to the fifth embodiment, except that the rotation restriction unit Rr has a different configuration.

Figure 12A:
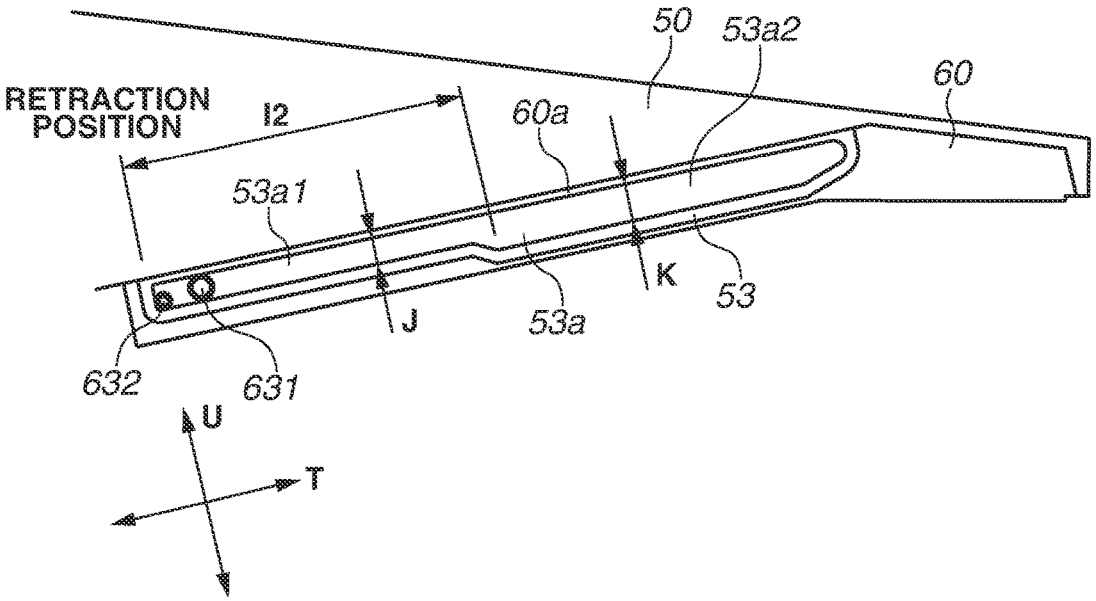
FIGS. 12A and 12B illustrate a configuration and movement of a sheet stacking device according to a sixth embodiment.
Figure 12B:
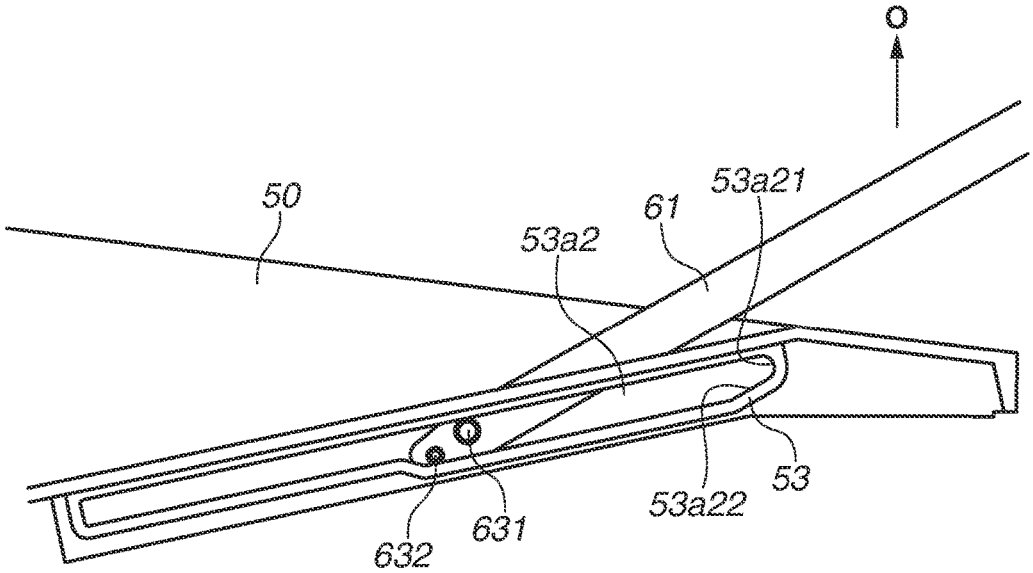

FIGS. 12A and 12B illustrate a configuration and movement of the sheet stacking device 70 according to the present embodiment. FIG. 12A is a cross sectional view illustrating the tray 50 and the expansion tray 60 in the retraction position in the section I2. FIG. 12B is a cross sectional view illustrating the tray 50 and the expansion tray 60 pivoted in the direction O opposite to the vertical direction V in a position beyond the section I2.

The expansion tray 60 includes a pair of large-diameter cylindrical portions 631 (only one of the cylindrical portions 631 is illustrated in FIG. 12A) and a pair of small-diameter cylindrical portions 632 (only one of the small-diameter cylindrical portions 632 is illustrated in FIG. 12A) having a smaller diameter than the diameter of the large-diameter cylindrical portions 631. The large-diameter cylindrical portions 631 and the small-diameter cylindrical portions 632 are provided to the lateral surfaces of the expansion tray 60. The two pairs of cylindrical portions 631 and 632 are provided on the rear edge portion side in the longitudinal direction of the expansion tray 60. In the present embodiment, the two pairs of cylindrical portions 631 and 632 are used in place of the pair of pivot shafts 63 according to the fifth embodiment.

The two pairs of cylindrical portions 631 and 632 are located at a predetermined distance from each other in the direction U which is orthogonal to the sheet stacking surface 50*a* of the tray 50 and which is orthogonal to the direction T parallel to the direction in which the expansion tray 60 is moved. The large-diameter cylindrical portion 631 is provided on the pull direction side (right hand side in FIGS. 12A and 12B) of the expansion tray 60, and the small-diameter cylindrical portion 632 is provided on the push direction (refer to FIG. 3A) side (left hand side in FIGS. 12A and 12B) of the expansion tray 60.

The guide portion 53 includes the pair of groove portions 53*a* (only one of the groove portions 53*a* is illustrated in FIG. 12A) for guiding the large-diameter cylindrical portion 631 and the small-diameter cylindrical portion 632 from the retraction position to the extension position. The pair of groove portions 53*a*, the pair of large-diameter cylindrical portions 631, and the small-diameter cylindrical portions 632 together form the rotation restriction unit Rr.

The groove portion 53*a* includes the first groove 53*a*1 that supports the large-diameter cylindrical portion 631 in such a manner that the large-diameter cylindrical portion 631 can be moved in the predetermined section I2 from the retraction position to a position before the extension position. The groove portion 53*a* further includes the second groove 53*a*2 that supports the large-diameter cylindrical portion 631 in such a manner that the large-diameter cylindrical portion 631 can be pivoted in the region beyond the section I2 and up to the extension position.

In the retraction position, peripheral surfaces of the large-diameter cylindrical portion 631 and the small-diameter cylindrical portion 632 come into contact with the first groove 53*a*1 in the section I2 (refer to FIG. 12A). The peripheral surfaces of the large-diameter cylindrical portion 631 and the small-diameter cylindrical portion 632 are in contact with the first groove 53*a*1 also in a region of the section I2 that is on the right hand side of the retraction position. The width J of the first groove 53*a*1 is set substantially equal to the diameter of the large-diameter cylindrical portion 631. Thus, in the section I2, the large-diameter cylindrical portion 631 and the small-diameter cylindrical portion 632 are movably supported by the first groove 53*a*1 so that the expansion tray 60 can be moved along the first groove 53*a*1.

The width K of the second groove 53*a*2 is greater than the first groove 53*a*1. The width K is set to the size of an area in which the large-diameter cylindrical portion 631 and the small-diameter cylindrical portion 632 are both in contact with the second groove 53*a*2. Thus, in the region beyond the section I2 and up to the extension position, the expansion tray 60 can be pivoted in the direction O opposite to the vertical direction V within a predetermined range after the large-diameter cylindrical portion 631 comes into contact with the second groove 53*a*2 and until the small-diameter cylindrical portion 632 comes into contact with the second groove 53*a*2.

In the extension position, the large-diameter cylindrical portion 631 fits in the semi-circular depressed portion 53*a*21 of the second groove 53*a*2. If the expansion tray 60 in the extension position is pivoted in the direction O opposite to the vertical direction V by a user, the large-diameter cylindrical portion 631 is pivoted with respect to the depressed portion 53*a*21 of the second groove 53*a*2. If the expansion tray 60 is further pivoted in the direction O, a part of the peripheral surface of the small-diameter cylindrical portion 632 comes into contact with the end surface 53*a*22 of the second groove 53*a*2 to stop the pivoting of the expansion tray 60 in the direction O. Thus, the expansion tray 60 becomes pivotable on the pivot shaft 63 in the direction O opposite to the vertical direction V within a predetermined range.

In the sheet stacking device 70 according to the present embodiment, the expansion tray 60 can be pulled from and pushed into the tray 50. Further, the expansion tray 60 is supported by the tray 50 in such a manner that the expansion tray 60 can be pivoted in the direction O opposite to the vertical direction V. Accordingly, a similar benefit to that of the fifth embodiment is produced.

Further, in the sheet stacking device 70 according to the present embodiment, even if the user accidentally moves or pushes the expansion tray 60 upward, the tray 50 remains at rest.

Yet another example of the sheet stacking device 70 will be described below.

A sheet stacking device 70 according to a seventh embodiment has a similar configuration to that of the sheet stacking device 70 according to the first embodiment, except that the rotation restriction unit Rr has a different configuration.

Figure 13:
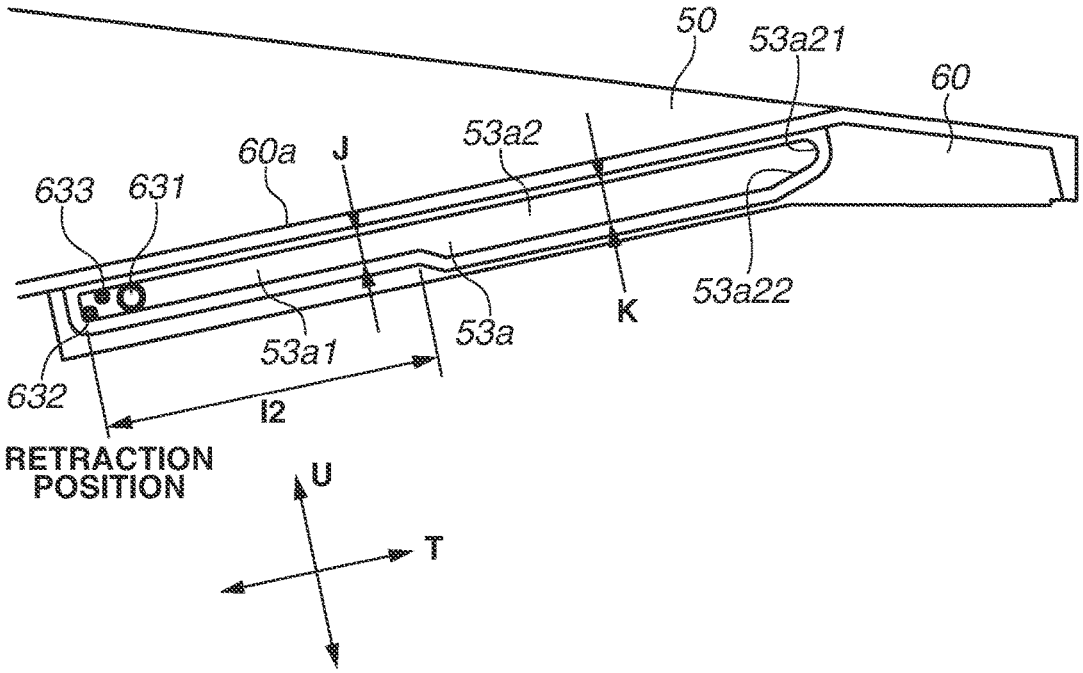
FIG. 13 illustrates a configuration and movement of a sheet stacking device according to a seventh embodiment.

FIG. 13 illustrates a configuration and movement of the sheet stacking device 70 according to the present embodiment. FIG. 13 is a cross sectional view illustrating the tray 50, and the expansion tray 60 in the extension position.

The expansion tray 60 includes the pair of large-diameter cylindrical portions 631 (only one of the large-diameter cylindrical portions 631 is illustrated in FIG. 13) and the pair of small-diameter cylindrical portions 632 (only one of the small-diameter cylindrical portions 632 is illustrated in FIG. 13) having a smaller diameter than the diameter of the large-diameter cylindrical portions 631. The pair of large-diameter cylindrical portions 631 and the pair of small-diameter cylindrical portions 632 are provided to the lateral surfaces of the expansion tray 60. The expansion tray 60 further includes the pair of smallest-diameter cylindrical portions 633 (only one of the smallest-diameter cylindrical portions 633 is illustrated in FIG. 13) having a smaller diameter than the diameter of the small-diameter cylindrical portions 622.

The three pairs of cylindrical portions 631, 632, and 633 are provided on the rear edge portion side in the longitudinal direction of the expansion tray 60. In the present embodiment, the three pairs of cylindrical portions 631, 632, and 633 are used in place of the pivot shafts 63 according to the fifth embodiment.

The three pairs of cylindrical portions 631, 632, and 633 are located at a predetermined distance from each other in the direction U which is orthogonal to the sheet stacking surface 60*a* of the expansion tray 60 and which is orthogonal to the direction T parallel to the direction in which the expansion tray 60 is moved. The large-diameter cylindrical portion 631 is provided on the pull direction side (right hand side in FIG. 13) of the expansion tray 60, the small-diameter cylindrical portion 632 on the push direction side (left hand side in FIG. 13) of the expansion tray 60, and the smallest-diameter cylindrical portion 633 between the large-diameter cylindrical portion 631 and the small-diameter cylindrical portion 632.

The guide portions 53 include the pair of groove portions 53*a* (only one of the groove portions 53*a* is illustrated in FIG. 13) for guiding the large-diameter cylindrical portions 631, the small-diameter cylindrical portions 632, and the smallest-diameter cylindrical portions 633 from the retraction position to the extension position. The pair of groove portions 53*a*, the pair of large-diameter cylindrical portions 631, the pair of small-diameter cylindrical portions 632, and the pair of smallest-diameter cylindrical portions 633 together form the rotation restriction unit Rr.

The groove portion 53*a* includes the first groove 53*a*1 that supports the large-diameter cylindrical portion 631 in such a manner that the large-diameter cylindrical portion 631 can be moved in the predetermined section I2 from the retraction position to a position before the extension position. The groove portion 53*a* further includes the second groove 53*a*2 that supports the large-diameter cylindrical portion 631 in such a manner that the large-diameter cylindrical portion 631 can be pivoted in the region beyond the section I2 and up to the extension position.

In the retraction position, the peripheral surfaces of the large-diameter cylindrical portion 631, the small-diameter cylindrical portion 632, and the smallest-diameter cylindrical portion 633 come into contact with the first groove 53*a*1 in the section I2. The peripheral surfaces of the large-diameter cylindrical portion 631, the small-diameter cylindrical portion 632, and the smallest-diameter cylindrical portion 633 are in contact with the first groove 53*a*1 also in a region of the section I2 that is on the right hand side of the retraction position. The width J of the first groove 53*a*1 is set substantially equal to the diameter of the large-diameter cylindrical portions 631. Thus, in the section I2, the large-diameter cylindrical portion 631, the small-diameter cylindrical portion 632, and the smallest-diameter cylindrical portion 633 are movably supported by the first groove 53*a*1 so that the expansion tray 60 can be moved along the first groove 53*a*1.

The width K of the second groove 53*a*2 is greater than the first groove 53*a*1. The width K is set to the size of an area in which the large-diameter cylindrical portion 631 and the small-diameter cylindrical portion 632 are both in contact with the second groove 53*a*2. Thus, in the region beyond the section I2 and up to the extension position, the expansion tray 60 can be pivoted in the direction O opposite to the vertical direction V within a predetermined range after the large-diameter cylindrical portion 631 comes into contact with the second groove 53*a*2 and until the small-diameter cylindrical portion 632 comes into contact with the second groove 53*a*2.

In the extension position, the large-diameter cylindrical portion 631 fits in the semi-circular depressed portion 53*a*21 of the second groove 53*a*2. Further, in the extension position, a part of the peripheral surface of the smallest-diameter cylindrical portion 633 is in contact with the second groove 53*a*2.

If the expansion tray 60 in the extension position is pivoted in the direction O opposite to the vertical direction V by a user, the large-diameter cylindrical portion 631 is pivoted with respect to the depressed portion 53*a*21 of the second groove 53*a*2. If the expansion tray 60 is further pivoted in the direction O, a part of the peripheral surface of the small-diameter cylindrical portion 632 comes into contact with the end surface 53*a*22 of the second groove 53*a*2 to stop the pivoting of the expansion tray 60 in the direction O. Thus, the expansion tray 60 becomes pivotable on the pivot shaft 63 in the direction O opposite to the vertical direction V within a predetermined range.

In the sheet stacking device 70 according to the present embodiment, the expansion tray 60 can be pulled from and pushed into the tray 50. Further, the expansion tray 60 is supported by the tray 50 in such a manner that the expansion tray 60 can be pivoted in the direction O opposite to the vertical direction V. Accordingly, a similar benefit to that of the fifth embodiment is produced. Further, in the sheet stacking device 70 according to the present embodiment, a part of the peripheral surface of the smallest-diameter cylindrical portion 633 is in contact with the second groove 52*a*2 in the extension position to produce a benefit that the orientation (orientation of the expansion tray 60 before being pivoted) of the expansion tray 60 with respect to the tray 50 in the extension position is stabilized.

Yet another example of the sheet stacking device 70 will be described below.

A sheet stacking device 70 according to an eighth embodiment has a similar configuration to that of the sheet stacking device 70 according to the fifth embodiment, except that the rotation restriction unit Rr has a different configuration.

Figure 14A:
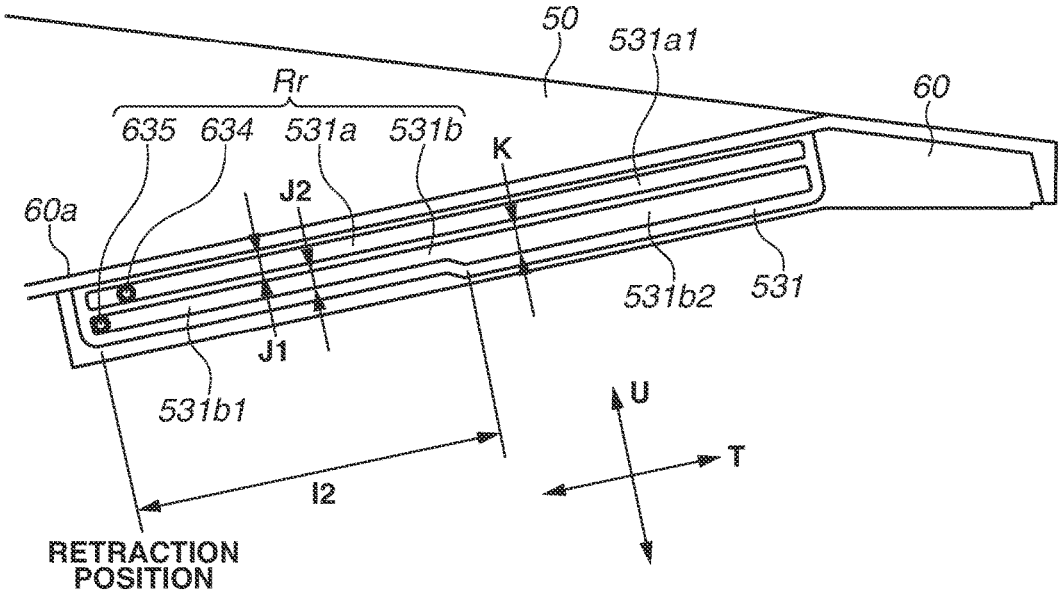
FIGS. 14A and 14B illustrate a configuration of a sheet stacking device according to an eighth embodiment.
Figure 14B:
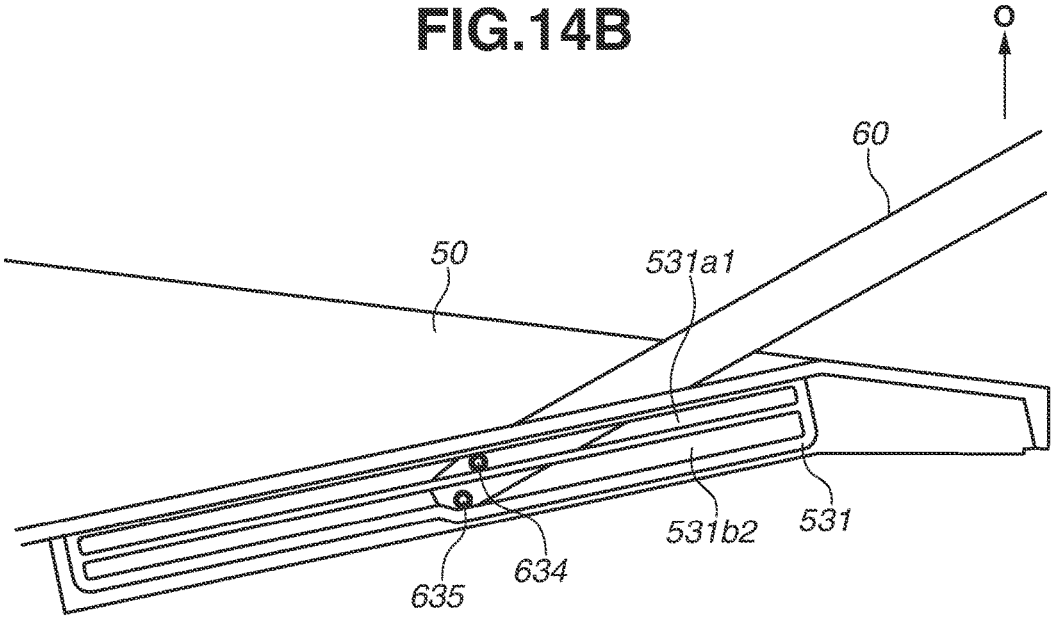

FIGS. 14A and 14B illustrate a configuration and movement of the sheet stacking device 70 according to the present embodiment. FIG. 14A is a cross sectional view illustrating the tray 50 and the expansion tray 60 in the retraction position in the section I2. FIG. 14B is a cross sectional view illustrating the tray 50 and the expansion tray 60 pivoted in the direction O opposite to the vertical direction V in a position beyond the section I2.

The expansion tray 60 includes a pair of first cylindrical portions 634 (only one of the first cylindrical portions 634 is illustrated in FIG. 14A) and a pair of second cylindrical portions 635 (only one of the second cylindrical portions 635 is illustrated in FIG. 14A) provided to the lateral surfaces of the expansion tray 60. The pairs of cylindrical portions 634 and 635 are provided on the rear edge portion side in the longitudinal direction of the expansion tray 60. In the present embodiment, the pairs of cylindrical portions 634 and 635 are used in place of the pair of pivot shafts 63 according to the fifth embodiment.

The pairs of cylindrical portions 634 and 635 are located at a predetermined distance from each other in the direction U which is orthogonal to the sheet stacking surface 60*a* of the expansion tray 60 and which is orthogonal to the direction T parallel to the direction in which the expansion tray 60 is moved. The pair of first cylindrical portions 634 is provided on the pull direction side (right hand side in FIGS. 14A and 14B) of the expansion tray 60, and the pair of second cylindrical portions 635 is provided on the push direction side (left hand side in FIGS. 14A and 14B) of the expansion tray 60.

The guide portion 531 includes a pair of first groove portions 531*a* (only one of the first groove portions 531*a* is illustrated in FIG. 14A) for guiding the first cylindrical portion 634 from the retraction position to the extension position. The guide portion 531 further includes a pair of second groove portions 532*b* (only one of the second groove portions 532*b* is illustrated in FIG. 14A) for guiding the second cylindrical portion 635 from the retraction position to the extension position. The pair of first groove portions 531*a*, the pair of second groove portions 532*b*, the pair of first cylindrical portions 634, and the pair of second cylindrical portions 635 together form the rotation restriction unit Rr.

The first groove portion 531*a* includes a groove 531*a*1 that supports the first cylindrical portion 634 in such a manner that the first cylindrical portion 634 can be moved in the predetermined section I2 from the retraction position to a position before the extension position. The second groove portion 531*b* includes a first groove 531*b*1 and a second groove 531*b*2. The first groove 531*b*1 supports the second cylindrical portion 635 in such a manner that the second cylindrical portion 635 can be moved in the predetermined section I2 from the retraction position to a position before the extension position. The second groove 531*b*2 supports the second cylindrical portion 635 in such a manner that the second cylindrical portion 635 can be pivoted in the region beyond the section I2 and up to the extension position.

In the retraction position, a peripheral surface of the first cylindrical portion 634 is in contact with the groove 531*a*1 and the second cylindrical portion 635 fits in an edge portion of the first groove 531*b*1 in the section I2 (refer to FIG. 14A).

The peripheral surface of the first cylindrical portion 634 is in contact with the groove 531*a*1 also in a region of the section I2 that is on the right hand side of the retraction position, and the peripheral surface of the second cylindrical portion 635 is in contact with the first groove 531*b*1.

The width J1 of the groove 531*a*1 is set substantially equal to the diameter of the first cylindrical portion 634, and the width J2 of the first groove 531*b*1 is set substantially equal to the diameter of the second cylindrical portion 635. Thus, in the section I2, the first cylindrical portion 634 and the second cylindrical portion 635 are movably supported by the groove 531*a*1 and the first groove 531*b*1, respectively, so that the expansion tray 60 can be moved along the groove 531*a*1 and the first groove 531*b*1.

The width K of the second groove 531*b*2 is greater than the first groove 531*b*1. In other words, the width K is set greater than the diameter of the second cylindrical portion 635. Thus, in the region beyond the section I2 and up to the extension position, the expansion tray 60 can be pivoted in the direction O opposite to the vertical direction V within a predetermined range until the second cylindrical portion 635 comes into contact with the second groove 531*b*2 with the first cylindrical portion 634 being in contact with the groove 531*a*1.

In the extension position, the first cylindrical portion 634 fits in an edge portion of the groove 531*a*1. If the expansion tray 60 in the extension position is pivoted in the direction O opposite to the vertical direction V by a user, the second cylindrical portion 635 comes into contact with the second groove 531*b*1 to stop the pivoting of the expansion tray 60 in the direction O. Thus, the expansion tray 60 becomes pivotable on the first cylindrical portion 634 in the direction O opposite to the vertical direction V within a predetermined range.

In the sheet stacking device 70 according to the present embodiment, the expansion tray 60 can be pulled from and pushed into the tray 50. Further, the expansion tray 60 is supported by the tray 50 in such a manner that the expansion tray 60 can be pivoted in the direction O opposite to the vertical direction V. Accordingly, a similar benefit to that of the fifth embodiment is produced.

A sheet stacking device 70 according to a ninth embodiment will be described below.

In the present embodiment, components that are similar to those of the sheet stacking device 70 according to the first embodiment are given the same reference numerals, and description of the components is omitted.

Figure 15A:
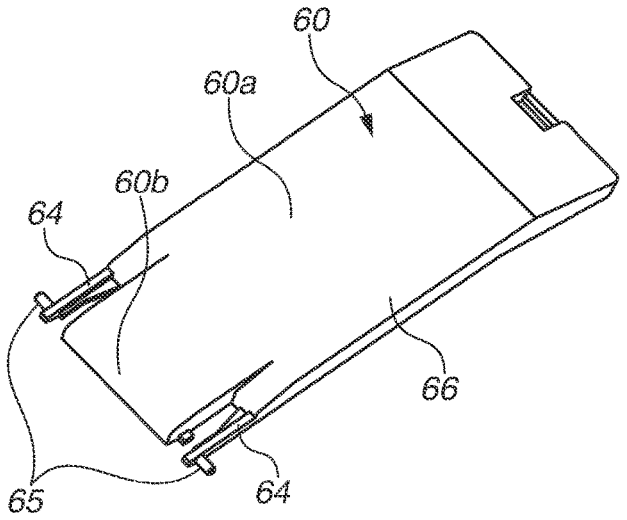
FIGS. 15A and 15B are perspective views illustrating movement of a sheet stacking device according to a ninth embodiment.
Figure 15B:
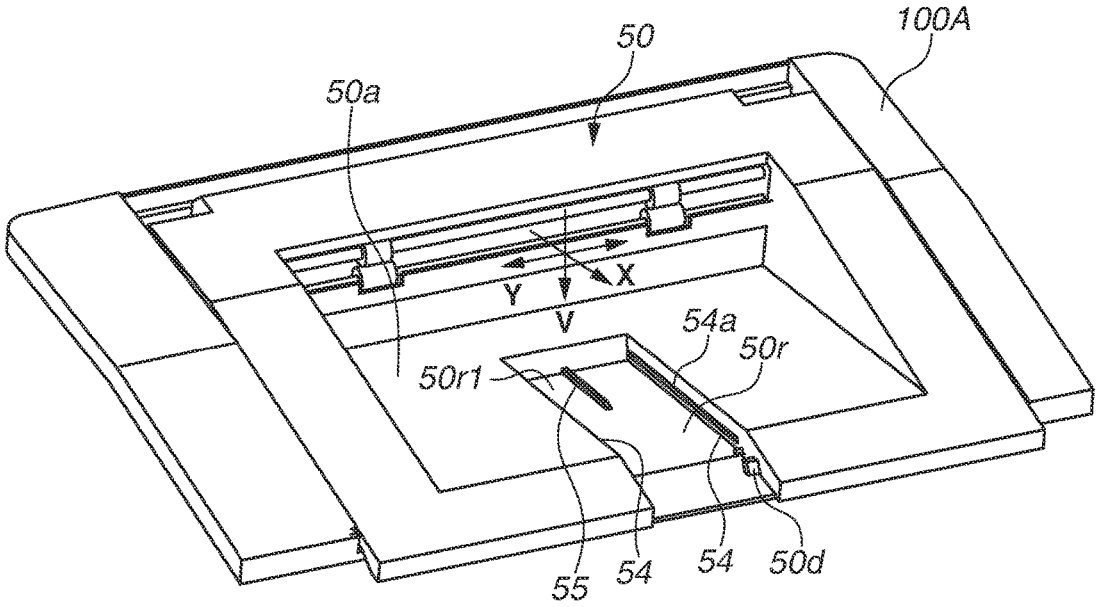

The following describes the tray 50 and the expansion tray 60 connected to the tray 50 with reference to FIGS. 15A and 15B.

FIG. 15A is a perspective view illustrating the expansion tray 60 viewed from the rear edge portion 60*b* side. FIG. 15B is a perspective view illustrating the tray 50 provided in the upper portion of the apparatus body 100A.

As illustrated in FIG. 15A, the expansion tray 60 is a member that is long in the discharge direction X (refer to FIG. 8A). The expansion tray 60 includes a pair of elastic portions 64 and a pair of pivot shafts (shaft) 65 on the rear edge portion 60*b* side in the longitudinal direction of the expansion tray 60. The pair of elastic portions 64 is elastically deformable in one of the vertical direction V and the direction O, which is opposite to the vertical direction V. The pair of pivot shafts 65 is provided to support the expansion tray 60 on the tray 50 via the elastic portions 64. The pair of pivot shafts 65 is provided to the lateral surfaces 66 (refer to FIG. 15A) of the expansion tray 60 in the width direction Y to support the expansion tray 60 on the tray 50 in such a manner that the expansion tray 60 can be pivoted.

As illustrated in FIG. 15B, the tray 50 includes the attachment portion 50*r* for attaching the expansion tray 60 on the front edge portion 50*c* side of the sheet stacking surface 50*a* of the tray 50 and the front edge portion side of the tray 50 in the discharge direction X. The attachment portion 50*r* is provided in the central region of the tray 50 in the width direction Y.

In the width direction Y of the tray 50, a pair of guide portions 54 is provided to the lateral surfaces of the attachment portion 50*r*. The pair of guide portions 54 is provided to guide the expansion tray 60. The pair of guide portions 54 includes groove portions 54*a* for guiding the pair of pivot shafts (shaft) 65, which will be described below, of the expansion tray 60 from the retraction position to the extension position. The pair of groove portions 54*a* includes grooves 54*a*1 which movably support the pair of pivot shafts 65. The pair of groove portions 54*a*, the pair of elastic portions 64, the pair of pivot shafts 65, a rotation restriction rib 55 described below, and a bottom surface 50*r*1 together form the rotation restriction unit Rr.

FIGS. 16A, 16B, 17A, 17B, 18A, and 18B illustrate the connection structure of the tray 50 and the expansion tray 60 and movement of the expansion tray 60. The pair of groove portions 54*a* has the same configuration, the pair of elastic portions 64 has the same configuration, and the pair of pivot shafts 65 has the same configuration, so only one of the groove portions 54*a*, one of the elastic portions 64, and one of the pivot shafts 65 will be described below.

Figure 16A:
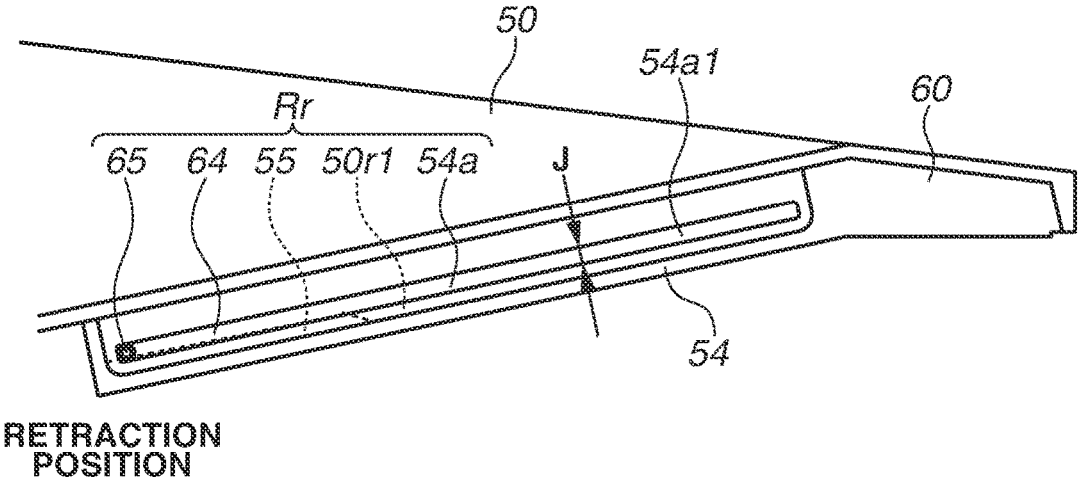
FIGS. 16A and 16B illustrate movement of the sheet stacking device according to the ninth embodiment.
Figure 16B:
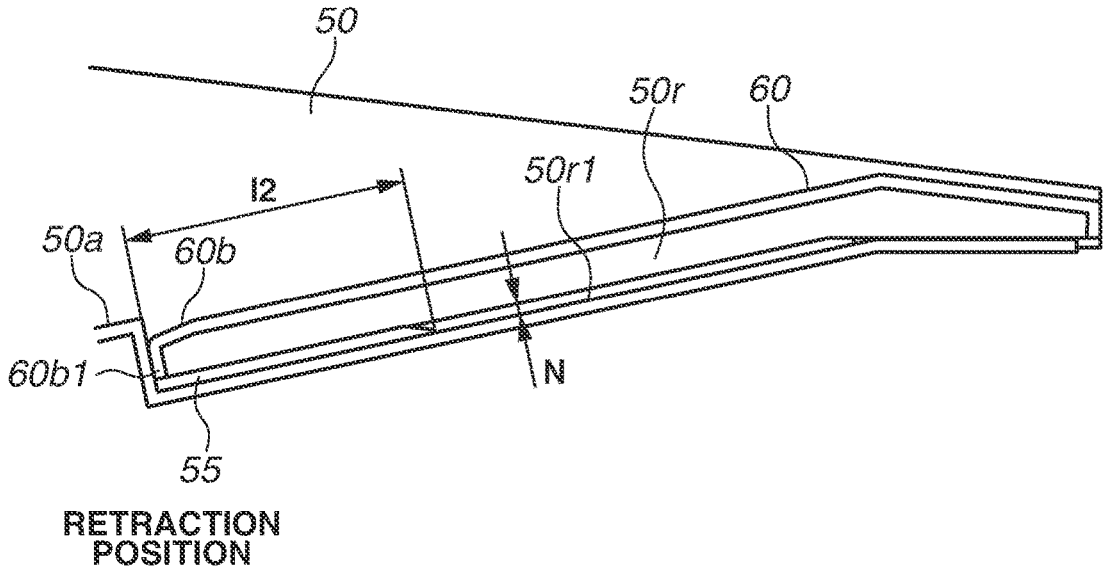

FIG. 16A is a cross sectional view illustrating the tray 50 and the expansion tray 60 in the retraction position. FIG. 16B is a cross sectional view illustrating the state in which the expansion tray 60 is in contact with the rotation restriction rib 55 in the retraction position.

Figure 17A:
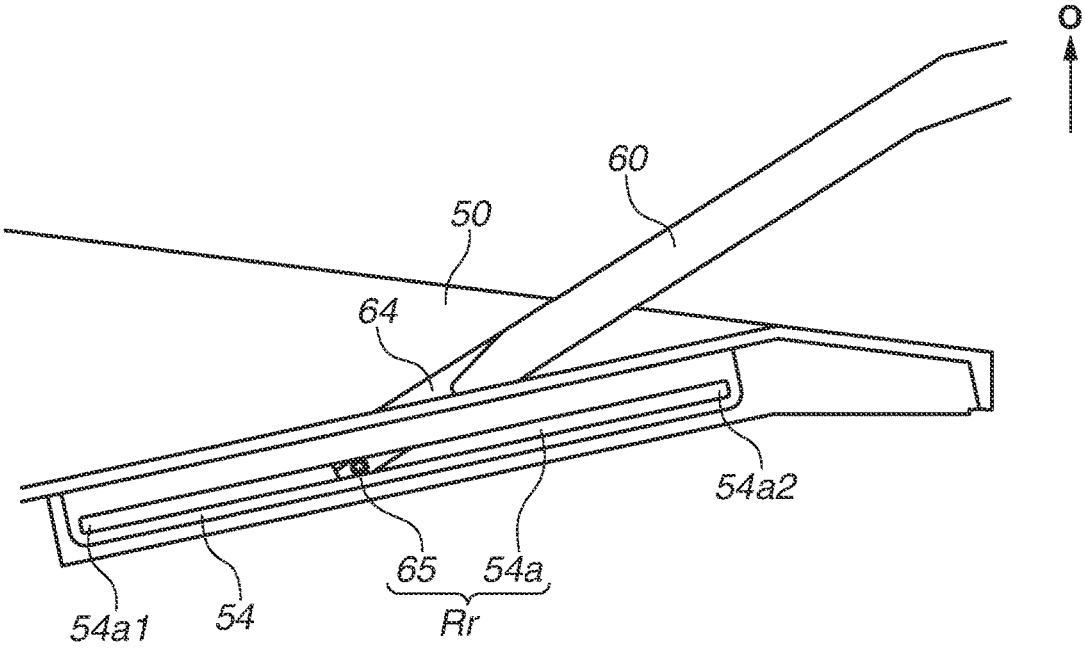
FIGS. 17A and 17B illustrate movement of the sheet stacking device according to the ninth embodiment.
Figure 17B:
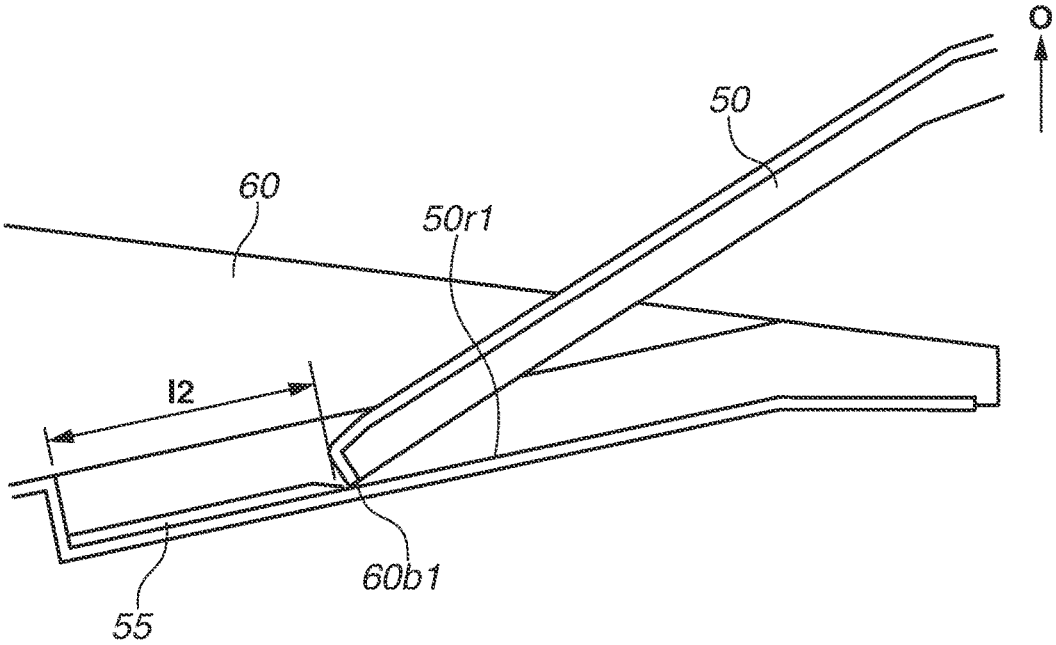

FIG. 17A is a cross sectional view illustrating the expansion tray 60 pivoted in the direction O opposite to the vertical direction V in a position beyond the section I2. FIG. 17B is a cross sectional view illustrating the state in which the expansion tray 60 with the expansion tray 60 pivoted in the direction O opposite to the vertical direction V in the position beyond the section I2 is in contact with the tray 50.

Figure 18A:
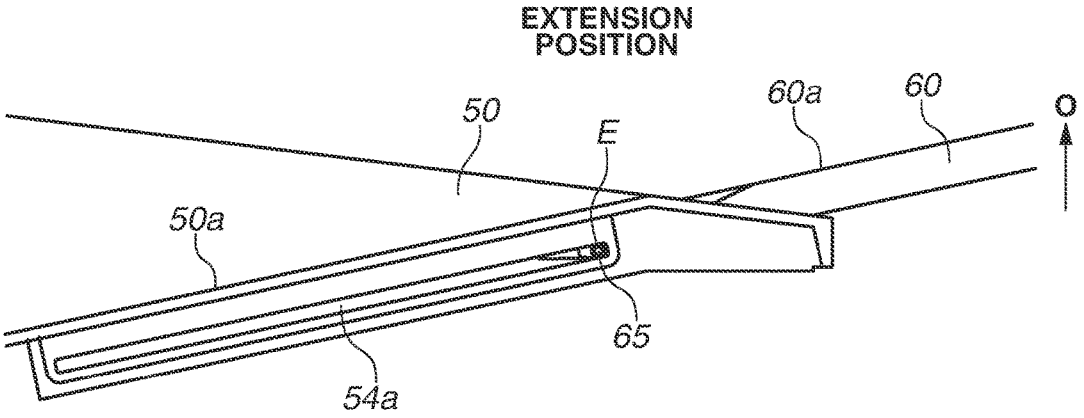
FIGS. 18A and 18B illustrate movement of the sheet stacking device according to the ninth embodiment.
Figure 18B:
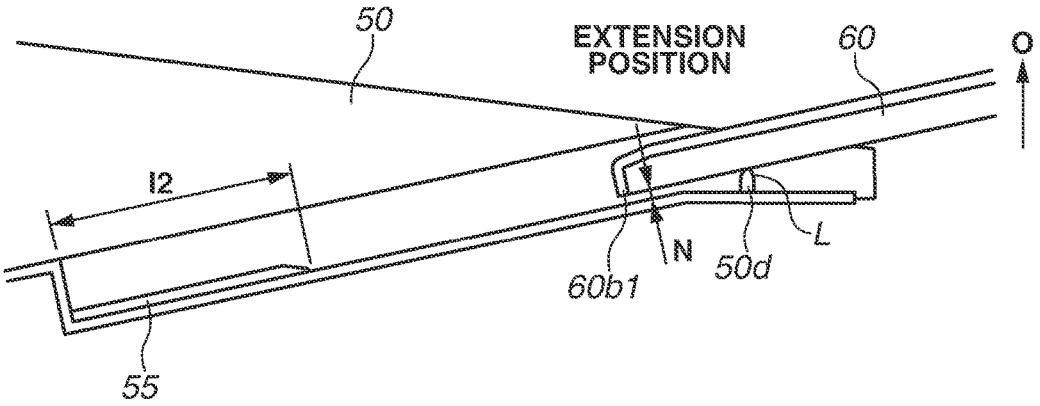

FIG. 18A is a cross sectional view illustrating the tray 50 and the expansion tray 60 in the extension position. FIG. 18B is a cross sectional view illustrating the state in which the expansion tray 60 in the extension position is in contact with the projection portion 50*d* of the tray 50.

The position of the expansion tray 60 can be selected from the retraction position illustrated in FIG. 16A and the extension position illustrated in FIG. 18A.

As illustrated in FIG. 16B, the rotation restriction rib (rotation restriction portion) 55 is provided to the bottom surface 50*r*1 of the attachment portion 50*r* of the tray 50 along the longitudinal direction of the expansion tray 60 in the predetermined section I2 from the retraction position of the expansion tray 60 to a position before the extension position. The rotation restriction rib 55 protrudes toward the sheet stacking surface 50*a* side of the tray 50 to form a space N between the rotation restriction rib 55 and the bottom surface (rotation restriction surface) 50*r*1 of the attachment portion 50*r*. Further, the rotation restriction rib 55 can abut against a lower edge portion 60*b*1 of the rear edge portion 60*b* of the expansion tray 60.

In the retraction position, the lower edge portion 60*b*1 of the expansion tray 60 comes into contact with the rotation restriction rib 55 in the section I2 (refer to FIG. 16B). Further, a peripheral surface of the pivot shaft 65 fits in the groove 54*a*1 (refer to FIG. 16A). The peripheral surface of the pivot shaft 65 is in contact with the groove 54*a*1 also in a region of the section I2 that is on the right hand side of the retraction position. The width J1 of the groove 54*a*1 is set substantially equal to the diameter of the pivot shaft 65. Thus, in the section I2, the pivot shaft 65 is movably supported by the groove 54*a*1 so that the expansion tray 60 can be moved along the groove 54*a*1.

In the region beyond the section I2 (refer to FIG. 16B) and up to a groove end 54*a*2 (refer to FIG. 17A) at the extension position (refer to FIG. 18A), while the peripheral surface of the pivot shaft 65 is in contact with the groove 54*a*1, the lower edge portion 60*b*1 of the expansion tray 60 is moved through the rotation restriction rib 55 and then comes into contact with the bottom surface 50*r*1 (refer to FIG. 17B). In this way, the expansion tray 60 can be pivoted on the pivot shaft 65 in the direction O opposite to the vertical direction V within a range in which the elastic portions 64 is elastically deformable.

In the extension position, the peripheral surface of the pivot shaft 65 fits in the groove 54*a*1 (refer to the first contact portion E in FIG. 18A). Further, in the extension position, the lower edge portion 60*b*1 of the expansion tray 60 is in contact with the projection portion 50*d* of the tray 50 in the central region of the tray 50 (refer to the second contact portion L in FIG. 18B). In this way, the expansion tray 60 is supported in stable orientation in the extension position by the second groove 53*a*2 to allow stable stacking of long sheets.

Further, in the extension position, the space N is formed between the lower edge portion 60*b*1 of the expansion tray 60 and the bottom surface 50*r*1 of the attachment portion 50*r*. Thus, the expansion tray 60 can be pivoted on the pivot shaft 65 in the direction O opposite to the vertical direction V within a range in which the elastic portions 64 is elastically deformable until the lower edge portion 60*b*1 of the expansion tray 60 comes into contact with the bottom surface 50*r*1.

More specifically, in the section I2, the pivoting of the expansion tray 60 in the direction O opposite to the vertical direction V is restricted, and in the region beyond the section I2 and up to the extension position, the expansion tray 60 can be pivoted in the direction O opposite to the vertical direction V within a range in which the elastic portions 64 is elastically deformable.

In the sheet stacking device 70 according to the present embodiment, the expansion tray 60 can be pulled from and pushed into the tray 50. Further, the expansion tray 60 is supported by the tray 50 in such a manner that the expansion tray 60 can be pivoted in the direction O opposite to the vertical direction V. Accordingly, a similar benefit to that of the fifth embodiment is produced. Further, the expansion tray 60 is supported by the tray 50 in such a manner that the expansion tray 60 can be pivoted in the direction O opposite to the vertical direction V. Accordingly, a similar benefit advantage to that of the first embodiment is produced. Further, in the region beyond the section I2 and up to the extension position, the expansion tray 60 can be pivoted in the direction O opposite to the vertical direction V. Thus, the expansion tray 60 can be moved and rotated with respect to the tray 50 with ease, compared to the first embodiment.

Further, in the sheet stacking device 70 according to the present embodiment, when the expansion tray 60 in the extension position is pivoted in the direction O opposite to the vertical direction V, the elasticity of the elastic portions 64 produces force to bring the expansion tray 60 back to the extension position. Further, the elasticity of the elastic portions 64 can absorb a shake generated when the expansion tray 60 is pulled from the retraction position or pivoted from the extension position. This reduces the risk of damage to the pivot shaft 65.

Further, in the sheet stacking device 70 according to the present embodiment, even if the user accidentally moves or pushes the expansion tray 60 upward, the tray 50 remains at rest.

Further, in the sheet stacking device 70 according to the present embodiment, the position and height of the rotation restriction rib 55 and the number of rotation restriction ribs 55 can be changed to allow the expansion tray 60 to be pivoted in a specified position and to set the pivot angle restriction more suitably.

Further, the guide portion 54 can be provided to the back surface of the expansion tray 60 as in the sheet stacking device 70 according to the first embodiment so that the expansion tray 60 can be pivoted only in the extension position.

While the elastic portions 64 are integrated with the expansion tray 60 in the present embodiment, the elastic portions 64 and the expansion tray 60 can be separate members.

In the image forming apparatus 100 including the sheet stacking device 70 according to the present embodiment, the expansion tray 60 is pulled and pivoted, so the expansion tray 60 can be pulled to a necessary length for stacking long sheets without the constraint described in the first embodiment. Further, in the sheet stacking device 70, when the expansion tray 60 in the extension position is pivoted in the direction O opposite to the vertical direction V, the expansion tray 60 comes into contact with the image reading apparatus 80 to restrict the pivoting of the expansion tray 60 before the pivoting of the expansion tray 60 in the direction O is restricted by the rotation restriction unit Rr.

Further, in the region beyond the section I2 and up to the extension position, the expansion tray 60 of the sheet stacking device 70 can be pivoted in the direction O opposite to the vertical direction V. Thus, in the image forming apparatus 100 including the sheet stacking device 70 according to the present embodiment, the expansion tray 60 can be pulled and pushed smoothly during printing operations.

Further, in the image forming apparatus 100 including the sheet stacking device 70 according to the present embodiment, the pivot shafts 65 are provided to the elastic portions 64 of the expansion tray 60. Thus, when the expansion tray 60 is pulled from the retraction position or pushed from the extension position, a damper effect is obtained to allow smoother movement of the expansion tray 60.

A sheet stacking device 70 according to a tenth embodiment will be described below.

In the present embodiment, components that are similar to those of the sheet stacking device 70 according to the first embodiment are given the same reference numerals, and description of the components is omitted.

Figure 19A:
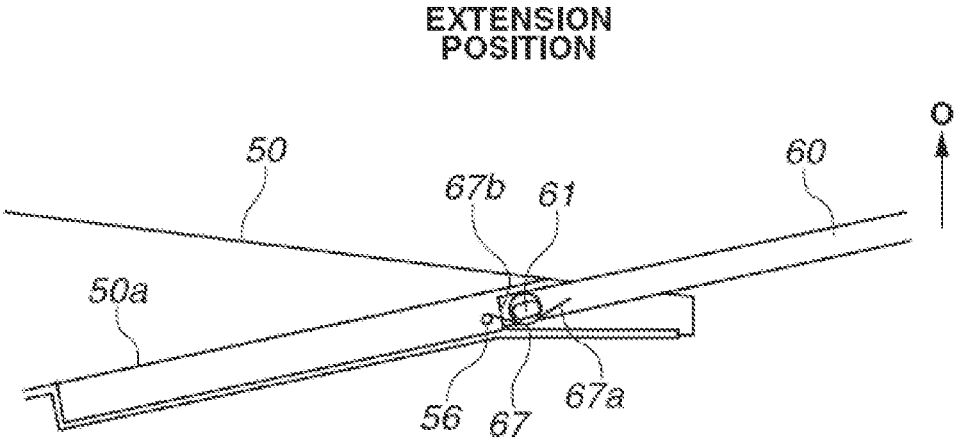
FIGS. 19A and 19B illustrate a configuration of a sheet stacking device according to a tenth embodiment.
Figure 19B:
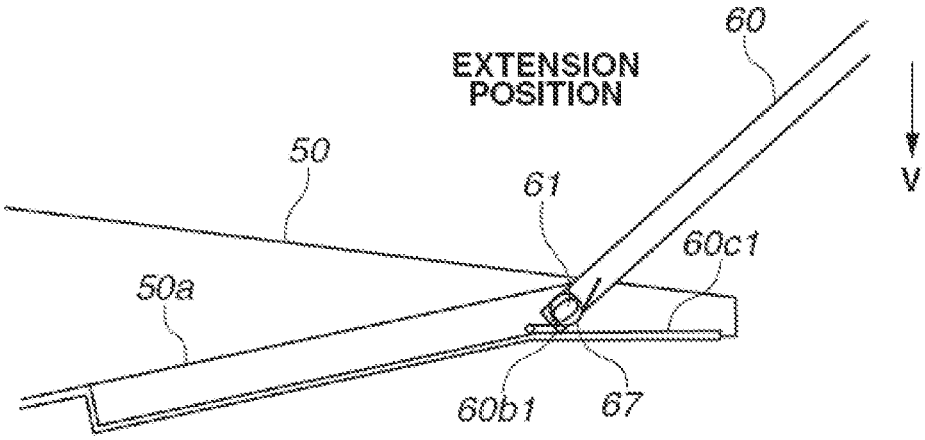

FIGS. 19A and 19B illustrate a configuration of the sheet stacking device 70 according to the present embodiment. FIG. 19A illustrates the pivot shaft 61 and an elastic member 67 of the expansion tray 60 in the extension position. FIG. 19B illustrates the action of the elastic member 67.

A metal spring or a torsion spring made of resin is used as the elastic member 67. The elastic member (torsion spring) 67 is attached to the pivot shaft 61 of the expansion tray 60. One edge 67*a* of the torsion spring 67 is stopped in an engaged state by the expansion tray 60, and the other end 67*b* is stopped in an engaged state by a pin 56 provided to a sliding member (not illustrated) which is slidable on the tray 50. In this case, no elastic force is produced by the torsion spring 67. When the expansion tray 60 is pivoted in the direction O opposite to the vertical direction V, a part (lower edge portion 60*b*1 as an example in FIG. 19B) of the expansion tray 60 comes into contact with a surface 60*c*1 on the front edge portion side of the tray 50, and the torsion spring 67 thus produces elastic force. The elastic force acts to bring the expansion tray 60 back toward the direction (vertical direction V) of the extension position.

More specifically, when the expansion tray 60 in the extension position is pivoted in the direction O opposite to the vertical direction V, the torsion spring 67 produces force that acts to bring the expansion tray 60 back to the extension position.

The foregoing describes the case in which the torsion spring 67 is applied to the pivot shafts 61 of the sheet stacking device 70 according to the first embodiment. The torsion spring 67 is also applicable to the large-diameter cylindrical portions 621 according to the second and third embodiments and the cylindrical portions 624 according to the fourth embodiment. In this case, when the expansion tray 60 in the extension position is pivoted in the direction O opposite to the vertical direction V, the torsion spring 67 produces force that acts to bring the expansion tray 60 back to the extension position.

Further, the torsion spring 67 is also applicable to the pivot shafts 63 according to the fifth embodiment, the large-diameter cylindrical portions 631 according to the sixth and seventh embodiments, and the cylindrical portions 634 according to the eighth embodiment. In this case, when the expansion tray 60 is pivoted in the direction O opposite to the vertical direction V in the region beyond the section I2 and up to the extension position, the torsion spring 67 produces force that acts to bring the expansion tray 60 back to the extension position.

The load of the torsion spring 67, position of action, angle of action, position of attachment of the torsion spring 67 to the expansion tray 60, etc. can be selected as appropriate to set the timing of action of the torsion spring 67 and the elastic force more precisely.

The torsion spring 67 does not produce elastic force until the expansion tray 60 comes into contact with the tray 50 to allow smooth movement of the expansion tray 60 when the expansion tray 60 is pulled from the retraction position or pivoted from the extension position.

The elastic member 67 is not limited to the torsion spring, and the type, number, etc. of the elastic member 67 can be selected as appropriate.

An image forming apparatus 100 according to an eleventh embodiment will be described below.

Figure 20:
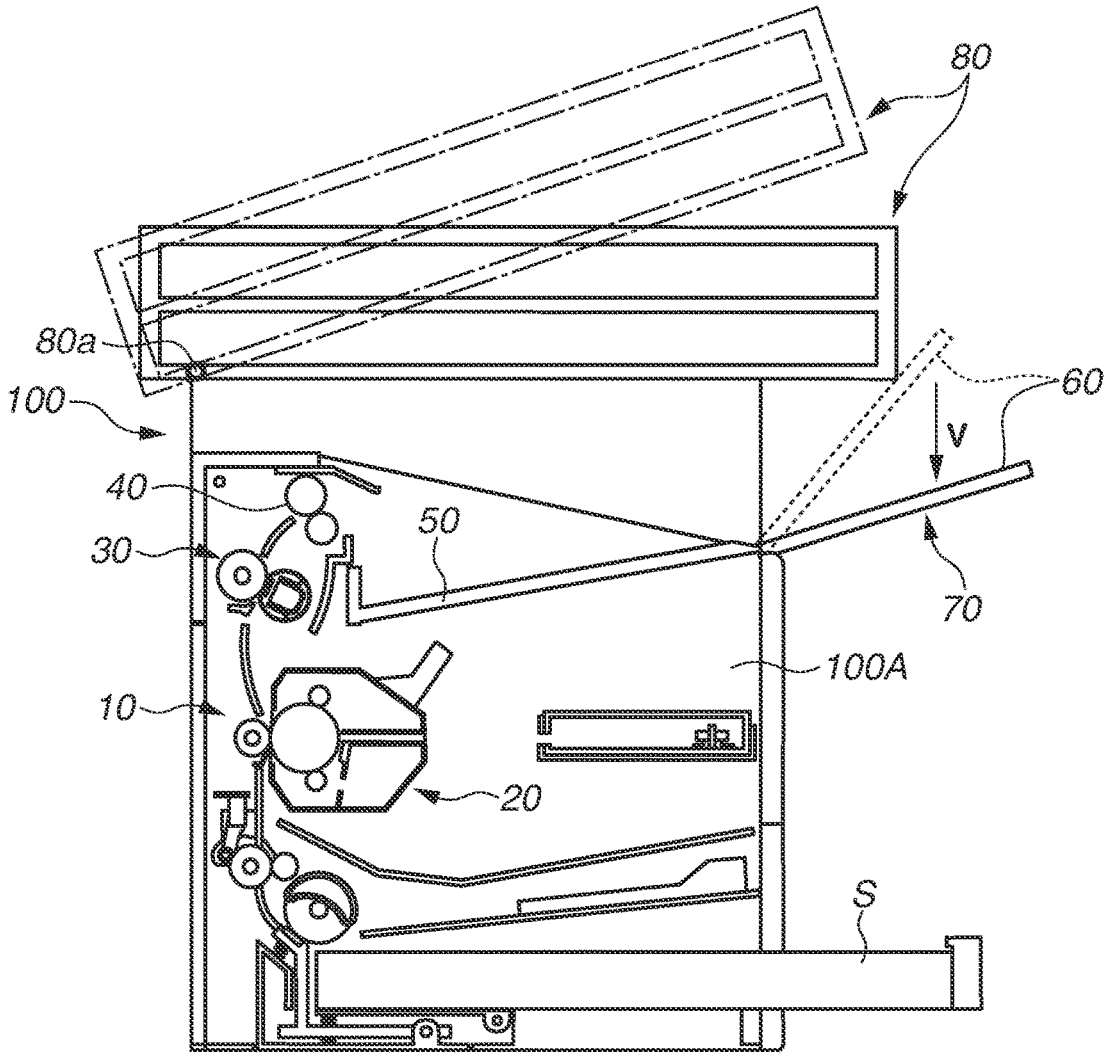
FIG. 20 schematically illustrates a configuration of an image forming apparatus including the sheet stacking device according to the tenth embodiment and an image reading apparatus.
Figure 21A:
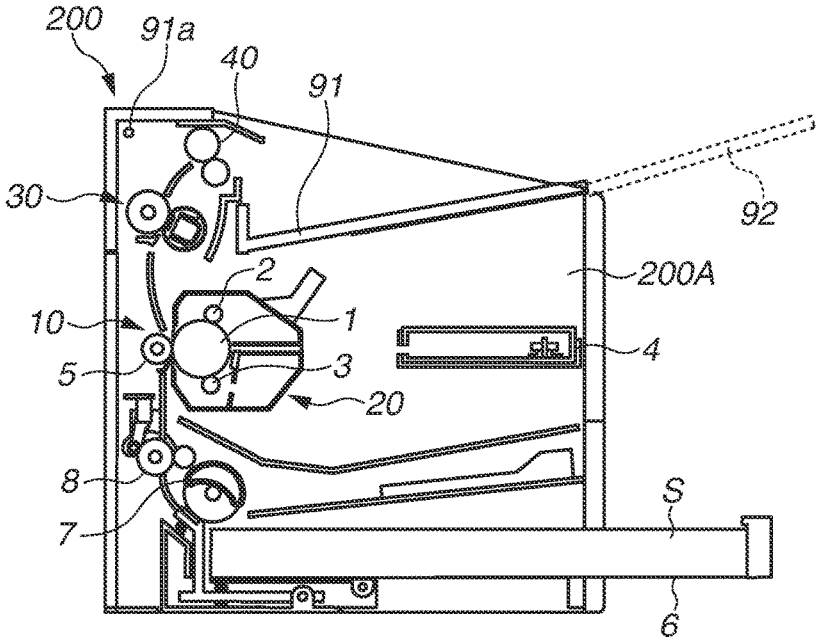
FIGS. 21A and 21B are cross sectional views illustrating a configuration of a conventional image forming apparatus.
Figure 21B:
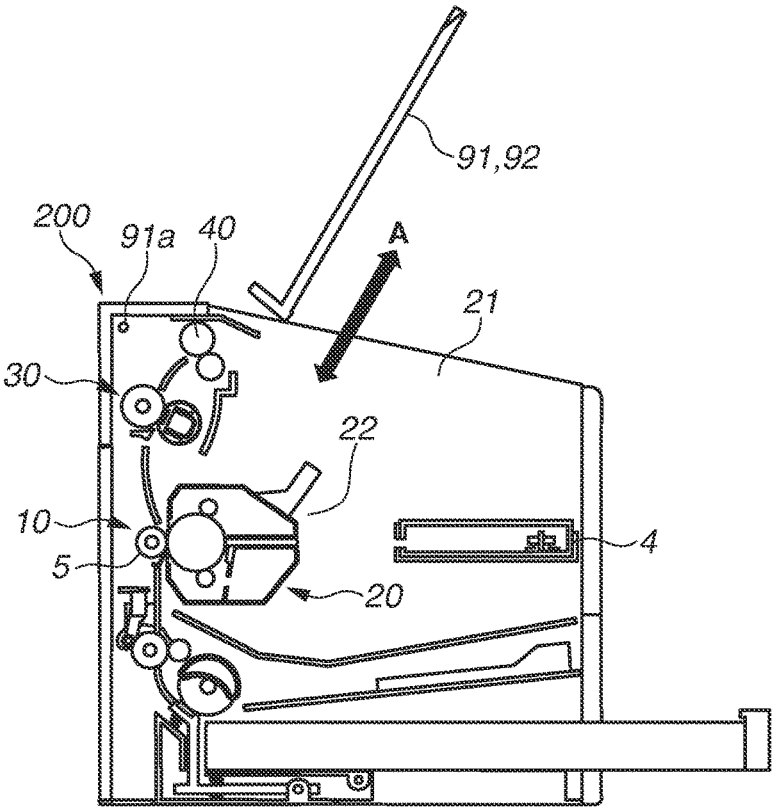

FIG. 20 illustrates the image forming apparatus 100 according to the present embodiment. FIG. 20 is a cross sectional view schematically illustrating a configuration of the image forming apparatus 100 including the sheet stacking device 70 according to the tenth embodiment and the image reading apparatus 80.

The image forming apparatus 100 according to the present embodiment includes the provided above the sheet stacking device 70.

The image reading apparatus 80 is provided with a predetermined space between the image reading apparatus 80 and the tray 50. Further, the image reading apparatus 80 can be pivoted upward from a closing position (position specified by real line in FIG. 20) where the image reading apparatus 80 can be located so that the tray 50 can be closed to close the opening portion 21 in the apparatus body 100A with respect to the apparatus body 100A. The image reading apparatus 80 pivots the tray 50 either in conjunction with or independently of the pivot movement to move to an open position (position specified by dashed-dotted line in FIG. 20) to open the opening portion 21. A pivot shaft 80*a* serves as a fulcrum when the image reading apparatus 80 is pivoted.

When the expansion tray 60 is in the extension position, if a user accidentally moves or pushes the expansion tray 60 upward, the expansion tray 60 abuts against a bottom surface (or side surface) of the image reading apparatus 80. Thus, the expansion tray 60 is not further rotated and is returned to the extension position due to the weight of the expansion tray 60 and the weight of the stacked sheets.

Even if the expansion tray 60 of the image forming apparatus 100 according to the present embodiment is accidentally moved or pushed upward, the expansion tray 60 is returned to the extension position, so suitable printing operations are realized without disturbing the discharged sheets S.

In the case in which the sheet stacking device 70 according to the tenth embodiment is included, the speed of the expansion tray 60 is reduced before the expansion tray 60 comes into contact with the bottom surface (or side surface) of the image reading apparatus 80 due to the action of the torsion spring 67. Consequently, an impact generated when the expansion tray 60 comes into contact with the image reading apparatus 80 is cancelled or the expansion tray 60 is returned to the extension position before coming into contact with the image reading apparatus 80 to reduce unpleasant impact sound and damage to the expansion tray 60, the image reading apparatus 80, etc.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-141003, filed Jul. 19, 2016, which is hereby incorporated by reference herein in its entirety.

What is claimed is:

1. A sheet discharge apparatus comprising:

a main tray on which a sheet is to be stacked and which is pivotable between a closed position at which the main tray is closed with respect to a main body of the sheet discharge apparatus and an opened position at which the main tray is opened with respect to the main body of the sheet discharge apparatus;

a discharge unit configured to discharge the sheet onto the main tray in a case where the main tray is at the closed position; and an expansion tray configured to expand a stacking area of the main tray, wherein the expansion tray is provided to the main tray and movable between a storage position towards which the expansion tray is slid to be stored at the storage position substantially within the main tray and an expansion position towards which the expansion tray is slid from the storage position in a sheet discharge direction to the expansion position to expand the stacking area, wherein, at the expansion position, the expansion tray is pivotable independently of the main tray on a pivot center in a vertically upward direction as limited by a predetermined angle, wherein the predetermined angle is in a range of 20 degrees or more to 90 degrees or less in the vertically upward direction with respect to the expansion position, and wherein a direction in which the expansion tray is pivoted in the vertically upward direction is the same as a direction in which the main tray is pivoted from the closed position to the opened position.

2. The sheet discharge apparatus according to claim 1, wherein the expansion tray is pivotable independently of the main tray in a state in which the main tray is at the closed position.

3. The sheet discharge apparatus according to claim 1, wherein the main tray includes a region where pivoting of the expansion tray is restricted while the expansion tray is slid in the sheet discharge direction toward the pivot center.

4. The sheet discharge apparatus according to claim 1, wherein, beyond the storage position, the expansion tray projects from the main tray in the sheet discharge direction.

5. The sheet discharge apparatus according to claim 1, wherein, in a case where the expansion tray is pivoted in the vertically upward direction from the expansion position to abut a surface of the sheet discharge apparatus, the expansion tray is restricted from further rotation in the vertically upward direction and weight of the expansion tray urges the expansion tray to return to the extension position.

6. The sheet discharge apparatus according to claim 1, wherein the pivot center of the expansion tray is provided at a position closer to an upstream edge of the expansion tray than a downstream edge of the expansion tray in the sheet discharge direction.

7. The sheet discharge apparatus according to claim 6, wherein the main tray includes a region where pivoting of the expansion tray is restricted while the expansion tray is slid in the sheet discharge direction toward the pivot center.

8. The sheet discharge apparatus according to claim 6, wherein, beyond the storage position, the expansion tray projects from the main tray in the sheet discharge direction.

9. The sheet discharge apparatus according to claim 6, wherein, in a case where the expansion tray is pivoted in the vertically upward direction from the expansion position to abut a surface of the sheet discharge apparatus, the expansion tray is restricted from further rotation in the vertically upward direction and weight of the expansion tray urges the expansion tray to return to the extension position.

10. The sheet discharge apparatus according to claim 1, wherein the main tray includes a first groove, a second groove located downstream from the first groove in the sheet discharge direction, and a main tray stop located adjacent to the second groove, wherein the expansion tray includes a stop surface and includes a pivot shaft that is positioned to slide within the first groove from the storage position towards the expansion position, and wherein, in a case where the pivot shaft is positioned at the second groove and the expansion tray is rotated to the predetermined angle, the stop surface of the expansion tray comes in contact with the main tray stop to prevent further rotation of the expansion tray in the vertically upward direction.

11. The sheet discharge apparatus according to claim 10, wherein the main tray and the expansion tray cooperate together to form a rotation restriction unit that restricts expansion of the stacking area and rotation of the expansion tray relative to the main tray, wherein the first groove, the second groove, and the main tray stop are part of a groove portion, and wherein the groove portion and the pivot shaft form the rotation restriction unit.

12. The sheet discharge apparatus according to claim 10, wherein the main tray and the expansion tray cooperate together to form a rotation restriction unit that restricts expansion of the stacking area and rotation of the expansion tray relative to the main tray, wherein the main tray stop is part of a third groove having an inlet and shaped to branch from the first groove, wherein the first groove, the second groove, and the third groove form a groove portion, wherein the pivot shaft is a first cylindrical portion, wherein the stop surface is part of a second cylindrical portion having a diameter that is smaller than a diameter of the first cylindrical portion.

13. The sheet discharge apparatus according to claim 12, wherein the main tray and the expansion tray cooperate together to form a rotation restriction unit that restricts expansion of the stacking area and rotation of the expansion tray relative to the main tray, and wherein the groove portion, the first cylindrical portion, and the second cylindrical portion form the rotation restriction unit.

14. The sheet discharge apparatus according to claim 12, wherein the main tray and the expansion tray cooperate together to form a rotation restriction unit that restricts expansion of the stacking area and rotation of the expansion tray relative to the main tray, wherein the expansion tray further includes a third cylindrical portion having a diameter that is smaller than the diameter of the second cylindrical portion, wherein the third cylindrical portion is positioned so that, when the expansion tray is at the expansion position and before the expansion tray is pivoted, the third cylindrical portion is in contact with the second groove in a way that stabilizes an orientation of the expansion tray with respect to the main tray, and wherein the groove portion, the first cylindrical portion, the second cylindrical portion, and the third cylindrical portion form the rotation restriction unit.

15. The sheet discharge apparatus according to claim 12, wherein the main tray and the expansion tray cooperate together to form a rotation restriction unit that restricts expansion of the stacking area and rotation of the expansion tray relative to the main tray, wherein the second cylindrical portion includes two flat surface portions connected between first and second arc-shaped portions, wherein the second arc-shaped portions is positioned so that, when the expansion tray is at the expansion position and before the expansion tray is pivoted, the second arc-shaped portions is in contact with the second groove in a way that stabilizes an orientation of the expansion tray with respect to the main tray, and wherein the groove portion, the first cylindrical portion, and the second cylindrical portion form the rotation restriction unit.

* * * * *